US011864629B2

(12) United States Patent
Zieger

(10) Patent No.: US 11,864,629 B2
(45) **Date of Patent: *Jan. 9, 2024**

(54) SHOE COVER FOR PROTECTING CLEATS DURING ACTIVE USE

(71) Applicant: Max Zieger, Woodside, CA (US)

(72) Inventor: Max Zieger, Woodside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/669,227

(22) Filed: Feb. 10, 2022

(65) Prior Publication Data

US 2022/0160073 A1 May 26, 2022

Related U.S. Application Data

(63) Continuation of application No. 16/700,960, filed on Dec. 2, 2019, now Pat. No. 11,266,201.

(60) Provisional application No. 62/774,741, filed on Dec. 3, 2018.

(51) Int. Cl.

| | |
|---|---|
| ***A43B 5/18*** | (2006.01) |
| ***A43B 13/04*** | (2006.01) |
| ***A43B 3/16*** | (2022.01) |

(52) U.S. Cl.

CPC ..... *A43B 5/185* (2013.01); *A43B 3/16* (2013.01); *A43B 13/04* (2013.01)

(58) Field of Classification Search

CPC ..... A43B 5/185; A43B 3/16
USPC ..... 36/7.1 R, 135, 97
See application file for complete search history.

(56) References Cited

U.S. PATENT DOCUMENTS

| | | | | |
|---|---|---|---|---|
| 1,727,728 A | | 9/1929 | Gustandy | |
| 2,076,316 A | * | 4/1937 | Beals, Jr. | A43B 5/18 36/135 |
| 2,409,813 A | | 10/1946 | Timson | |
| 3,566,488 A | | 3/1971 | Pilarski | |
| 3,808,712 A | * | 5/1974 | Elliott | A43B 5/18 36/7.3 |
| 3,812,603 A | | 5/1974 | Goodman | |
| 3,821,858 A | | 7/1974 | Haselden | |
| 3,827,166 A | | 8/1974 | Goodman | |
| 3,858,336 A | | 1/1975 | Brown | |
| 3,883,963 A | | 5/1975 | Barbito, Sr. | |

(Continued)

FOREIGN PATENT DOCUMENTS

| | | |
|---|---|---|
| WO | WO 9108683 | 6/1991 |
| WO | WO 9810671 | 3/1998 |

(Continued)

OTHER PUBLICATIONS

Vibram Corporation, Wrap Tech product description, Retrieved Apr. 23, 2020 from: https://us.vibram.com/wrap-tech-WRAPTECH.html.

*Primary Examiner* — Marie D Bays
(74) *Attorney, Agent, or Firm* — MORRISON & FOERSTER LLP

(57) ABSTRACT

The present application provides for a shoe cover for protecting cleated shoes from contact with the ground while also allowing the wearer to run or engage in sporting activities while wearing the product, as well as kits that include the shoe cover and methods for the use and manufacturing of the shoe cover. A shoe cover as provided herein includes a sole, a first cover, a second cover, a first fastener, and a second fastener. Another shoe cover as provided herein includes a sole, a cover, and a fastener.

15 Claims, 8 Drawing Sheets

(56) References Cited

U.S. PATENT DOCUMENTS

| | | | | | |
|---|---|---|---|---|---|
| 3,913,243 | A * | 10/1975 | Arnold | A43B 5/185 | 36/135 |
| 4,055,005 | A | 10/1977 | Meinhart | | |
| 4,083,124 | A | 4/1978 | Michalak | | |
| 4,183,157 | A | 1/1980 | Counselman | | |
| 4,251,932 | A | 2/1981 | Love | | |
| 4,258,483 | A | 3/1981 | Hogue | | |
| 4,458,373 | A * | 7/1984 | Maslow | F16G 11/101 | 36/138 |
| 4,484,398 | A | 11/1984 | Goodwin | | |
| 4,693,019 | A | 9/1987 | Kim | | |
| 4,872,273 | A | 10/1989 | Smeed | | |
| 4,896,438 | A * | 1/1990 | DeBease | A43B 3/16 | 36/73 |
| 4,942,678 | A * | 7/1990 | Gumbert | A43B 1/14 | 36/11 |
| 4,969,277 | A | 11/1990 | Williams | | |
| 5,007,185 | A | 4/1991 | Lazarski | | |
| 5,031,342 | A | 7/1991 | Crook | | |
| 5,070,631 | A | 12/1991 | Fenton | | |
| 5,172,496 | A | 12/1992 | Vemi | | |
| 5,305,536 | A | 4/1994 | Depping | | |
| 5,337,491 | A | 8/1994 | Mascotte | | |
| 5,367,794 | A | 11/1994 | Adelstein | | |
| 5,600,901 | A | 2/1997 | Leonor | | |
| 5,600,902 | A | 2/1997 | Yavitz | | |
| 5,666,746 | A | 9/1997 | Pollard | | |
| 5,678,325 | A * | 10/1997 | Davidowitz | A43C 1/06 | 36/11 |
| 5,722,189 | A | 3/1998 | Johnson | | |
| 5,794,368 | A | 8/1998 | Kirby | | |
| 5,950,333 | A | 9/1999 | Tsen | | |
| 6,860,038 | B1 | 3/2005 | Stucke | | |
| 7,347,012 | B2 * | 3/2008 | Clark | A43B 3/124 | 36/50.1 |
| 7,383,646 | B2 | 6/2008 | Hall | | |
| 7,464,487 | B2 | 12/2008 | Boyd | | |
| 7,475,501 | B1 | 1/2009 | Detoro | | |
| 7,779,560 | B2 | 8/2010 | Kay | | |
| 8,215,038 | B1 | 7/2012 | Sattler | | |
| 8,387,287 | B2 | 3/2013 | Kay | | |
| 8,453,355 | B2 | 6/2013 | Kay | | |
| 8,474,153 | B2 | 7/2013 | Brie | | |
| 9,839,257 | B2 | 12/2017 | Fransko, Sr. | | |
| 9,861,157 | B1 | 1/2018 | Gair | | |
| 10,299,532 | B2 | 5/2019 | Cherosky | | |
| 10,376,014 | B2 | 8/2019 | Apostolopoulos | | |
| 11,266,201 | B2 * | 3/2022 | Zieger | A43B 3/16 | |
| 2002/0066208 | A1 | 6/2002 | Hall | | |
| 2004/0035026 | A1 | 2/2004 | Foster, Jr. | | |
| 2005/0022430 | A1 | 2/2005 | Terry | | |
| 2005/0160631 | A1 | 7/2005 | Love | | |
| 2006/0288615 | A1 | 12/2006 | Scheufele | | |
| 2007/0006490 | A1 * | 1/2007 | Kay | A43B 7/144 | 36/135 |
| 2007/0175064 | A1 * | 8/2007 | Culton | A43C 11/1493 | 36/7.1 R |
| 2007/0214680 | A1 * | 9/2007 | Marion | A43D 999/00 | 36/43 |
| 2008/0047169 | A1 | 2/2008 | Hoch | | |
| 2008/0052957 | A1 | 3/2008 | Taheri | | |
| 2008/0289223 | A1 | 11/2008 | Bernabeu | | |
| 2009/0049711 | A1 | 2/2009 | Finch | | |
| 2009/0100721 | A1 | 4/2009 | Gorynski | | |
| 2009/0241369 | A1 | 10/2009 | Votolato | | |
| 2009/0265959 | A1 | 10/2009 | Herber | | |
| 2011/0016744 | A1 | 1/2011 | Chan | | |
| 2011/0035964 | A1 | 2/2011 | Gallagher | | |
| 2011/0185598 | A1 | 8/2011 | Tsen | | |
| 2012/0036738 | A1 | 2/2012 | Willis | | |
| 2012/0066935 | A1 | 3/2012 | Opie | | |
| 2012/0272550 | A1 | 11/2012 | Parce | | |
| 2013/0104428 | A1 | 5/2013 | O'Brien | | |
| 2015/0113831 | A1 | 4/2015 | Weingart | | |
| 2015/0189948 | A1 | 7/2015 | Abrams | | |
| 2016/0143386 | A1 | 5/2016 | Cone | | |
| 2018/0116330 | A1 * | 5/2018 | Christian | A43B 13/187 | |
| 2018/0303192 | A1 | 10/2018 | Su | | |
| 2020/0170333 | A1 * | 6/2020 | Zieger | A43B 3/16 | |

FOREIGN PATENT DOCUMENTS

| | | |
|---|---|---|
| WO | WO 9848654 | 11/1998 |
| WO | WO 03043453 | 5/2003 |
| WO | WO 2007030910 | 3/2007 |
| WO | WO 2008027271 | 3/2008 |
| WO | WO 2009143230 | 11/2009 |
| WO | WO 2010036663 | 4/2010 |
| WO | WO 2010138681 | 12/2010 |
| WO | WO 2017071570 | 5/2017 |
| WO | WO 2018081518 | 5/2018 |

* cited by examiner

SHOE COVER FOR PROTECTING CLEATS DURING ACTIVE USE

CROSS-REFERENCE TO RELATED APPLICATIONS

This application is a continuation of U.S. Ser. No. 16/700,960, filed Dec. 2, 2019, now allowed, which claims priority from U.S. provisional application 62/774,741, filed Dec. 3, 2018. The contents of these applications are incorporated herein by reference.

BACKGROUND

Footwear of all kinds has become increasingly expensive. With this ever-increasing cost, there is a desire for products that protect footwear and cleats. Some types of footwear, such as athletic shoes with cleats for traction, are especially sensitive to a shortened life span if worn on hard surfaces that wear down the cleats. In addition, shoes with cleats can cause damage to flooring if worn inside a home or business and so the desire extends to protecting external surfaces from cleat damage.

To address these desires, some known products cover a cleated sole to thereby protect the cleats from damage or thereby protect a surface from damage. While these products may protect the cleated shoe and/or external surface, these products typically limit the wearer's activity, such as running and/or engaging in sports. If a shoe cover wearer does attempt to run or engage in sporting activities, known shoe covers are likely to fall off and/or create a risk of injury to the wearer, such as by tripping or falling. This is especially problematic in situations where athletes seek to warm up in areas with hard surfaces, but also want to protect their cleated shoes.

For at least these reasons, there is a need among consumers for a product that protects the cleated shoe from contact with the ground, extends the lifespan of the shoe, and allows the wearer to run or engage in sporting activities while wearing the product.

BRIEF SUMMARY

This disclosure provides shoe covers and methods which advantageously prolong the lifespan of a cleated shoe while also allowing the wearer to run or engage in sporting activities while wearing the shoe cover.

In some embodiments, the shoe cover includes a sole, a first cover, a second cover, a first fastener, and a second fastener. The sole makes contact with the cleats of the shoe to prevent the cleats from making contact with the ground. In some embodiments, the cleats align with a cavity in the sole to provide for a safe and secure fit between the shoe and the shoe cover. This fit between the cleat and the cavity prevents the cleated shoe from sliding either forward or backward while the wearer is running or engaging in sporting activities, for example. The first cover and the second cover are connected to the sole and, in combination, can wrap around the shoe. The first fastener reversibly connects the first cover and the second cover at the heel region such that the heel of the shoe is secured within the shoe cover. The second fastener reversibly connects the first cover and the second cover at the toe region such that the toe of the shoe is secured within the shoe cover. By securing the cleated shoe in the shoe cover, the wearer is able to safely run or engage in sporting activities. The first fastener allows for securing the heel end of the cleated shoe to the shoe cover and the second fastener allows for securing the toe end of the cleated shoe to the shoe cover. In combination, the first fastener and the second fastener provide for a safer and more secure fit for the cleated shoe within the shoe cover than a single fastener could typically provide. For example, the first fastener and the second fastener prevent the cleated shoe from sliding either forward or backward relative to the sole while the wearer is running or engaging in sporting activities. The first fastener and the second fastener, in part due to their positioning, also function to hold the cleated shoe tightly against the sole, which acts to prevent the cleated shoe from sliding either forward or backward relative to the sole when the wearer is active.

Provided herein is a shoe cover for use with a cleated shoe, comprising a sole; a first cover connected to the sole and comprising a toe region and a heel region; a second cover connected to the sole and comprising a toe region and a heel region; a first fastener that reversibly connects the heel region of the first cover and the heel region of the second cover; and a second fastener that reversibly connects the toe region of the first cover and the toe region of the second cover, wherein the shoe cover comprises a heel end and a toe end. In some of any such embodiments, the sole comprises a lower sole and an upper sole. In some of any such embodiments, the upper sole comprises a material selected from the group consisting of elastomeric material and foam material.

In some of any such embodiments, the shoe cover further comprises a sole insert. In some of any such embodiments, the sole comprises a lower sole and the sole insert comprises an upper sole. In some of any such embodiments, the sole insert and the shoe cover are reversibly attached. In some of any such embodiments, the shoe cover further comprises a sole insert casing that encompasses the sole insert. In some of any such embodiments, the sole insert casing and the shoe cover are reversibly attached. In some of any such embodiments, the sole insert comprises a material selected from the group consisting of elastomeric material and foam material.

In some of any such embodiments, the elastomeric material is a silicone rubber material. In some of any such embodiments, the elastomeric material comprises a cavity that aligns with a cleat protruding from a cleated shoe when the cleated shoe is properly inserted into the shoe cover. In some of any such embodiments, the cavity is formed by a process of contacting the cleat of the cleated shoe with the elastomeric material. In some of any such embodiments, the process of contacting the cleat of the cleated shoe with the elastomeric material is performed while the elastomeric material is in an uncured state. In some of any such embodiments, each cavity aligns with no more than one cleat of the cleated shoe.

In some of any such embodiments, the sole is positioned between a toe end and a heel end of the shoe cover. In some of any such embodiments, the first cover extends from the toe end of the shoe cover to the heel end of the shoe cover. In some of any such embodiments, the second cover extends from the toe end of the shoe cover to the heel end of the shoe cover. In some of any such embodiments, the first fastener and/or the second fastener comprises a strap. In some of any such embodiments, the first fastener and/or the second fastener comprises a hook and loop fastener. In some of any such embodiments, the first cover comprises a loop-compatible hook material or a hook-compatible loop material, and the second cover comprises a loop-compatible hook material or a hook-compatible loop material.

In some of any such embodiments, the shoe cover covers at least 50%, at least 55%, at least 60%, at least 65%, at least 70%, at least 75%, at least 80%, at least 85%, at least 90%, or at least 95% of the outer surface area of a cleated shoe when the cleated shoe is properly inserted into the shoe cover and the first fastener attaches the heel region of the first cover to the heel region of the second cover and the second fastener attaches the toe region of the first cover to the toe region of the second cover. In some of any such embodiments, the first cover and the second cover comprise a material selected from the group consisting of elastic material, elastomeric material, elasticized fabric, and mesh material.

Also provided herein is a method for covering a cleated shoe using any one of the shoe covers described herein, the method comprising inserting a cleated shoe into any one of the shoe covers described herein; connecting the first cover and the second cover using the first fastener; and connecting the first cover and the second cover using the second fastener. In some of any such embodiments, the cleated shoe is an athletic shoe selected from the group consisting of soccer shoes, football shoes, track & field shoes, baseball shoes, softball shoes, rugby shoes, cycling shoes, lacrosse shoes, and golf shoes. In some of any such embodiments, the cleated shoe is a boot. In some of any such embodiments, the cleated shoe comprises a cleat and the shoe cover comprises a cavity, and wherein each cavity aligns with no more than one cleat of the shoe when the cleated shoe is inserted into the shoe cover.

Also provided herein is a method for forming a cleat pattern in any one of the shoe covers described herein, the method comprising obtaining any one of the shoe covers described herein; obtaining a cleated shoe having a cleat pattern formed by one or more cleats; adding an elastomeric material in an uncured state to the sole; contacting the one or more cleats of the cleated shoe with the elastomeric material while the elastomeric material is in an uncured state; and curing the elastomeric material. In some of any such embodiments, the elastomeric material is a silicone rubber material.

Also provided herein is a method for forming a cleat pattern in any one of the shoe covers described herein, the method comprising obtaining any one of the shoe covers described herein; obtaining a cleated shoe having a cleat pattern formed by one or more cleats; obtaining a sole insert casing; adding an elastomeric material in an uncured state to the sole insert casing; contacting the one or more cleats of the cleated shoe with the elastomeric material while the elastomeric material is in an uncured state; and curing the elastomeric material. In some of any such embodiments, the elastomeric material is a silicone rubber material.

Also provided herein is a method for forming a cleat pattern in any shoe cover described herein, the method comprising obtaining any one of the shoe covers described herein; obtaining a cleated shoe having a cleat pattern formed by one or more cleats; obtaining a sole insert comprising an elastomeric material in an uncured state; contacting the one or more cleats of the cleated shoe with the elastomeric material while the elastomeric material is in an uncured state; and curing the elastomeric material. In some of any such embodiments, the elastomeric material is a silicone rubber material.

Also provided herein is a method for manufacturing a shoe cover for use with a cleated shoe, the method comprising providing a sole; connecting a first cover comprising a toe region and a heel region to the sole; connecting a second cover comprising a toe region and a heel region to the sole; providing a first fastener that reversibly connects the heel region of the first cover and the heel region of the second cover; and providing a second fastener that reversibly connects the toe region of the first cover and the toe region of the second cover. In some embodiments, the shoe cover comprises a heel end and a toe end.

Also provided herein is a kit comprising a pair of shoe covers, the kit comprising a pair of any one of the shoe covers described herein, wherein the pair comprises a shoe cover configured to cover a left shoe and a shoe cover configured to cover a right shoe.

Also provided herein is a kit comprising a pair of shoe covers, the kit comprising a pair of any one of the shoe covers described herein; and an elastomeric material in an uncured state, wherein the pair comprises a shoe cover configured to cover a left shoe and a shoe cover configured to cover a right shoe. In some of any such embodiments, the elastomeric material is provided within a container selected from the group consisting of a tube, vile, syringe, bottle, can, and tub. In some of any such embodiments, the elastomeric material is a silicone rubber material.

Also provided herein is a kit comprising a pair of shoe covers, the kit comprising a pair of any one of the shoe covers described herein; and a sole insert comprising an elastomeric material in an uncured state, wherein the pair comprises a shoe cover configured to cover a left shoe and a shoe cover configured to cover a right shoe. In some of any such embodiments, the elastomeric material is a silicone rubber material.

Also provided herein is a kit comprising a sole insert casing; and an elastomeric material in an uncured state.

Also provided herein is a kit comprising a sole insert comprising an elastomeric material in an uncured state.

Also provided herein is a kit comprising a sole insert comprising an elastomeric material that comprises a cavity.

Also provided herein is a shoe cover for use with a cleated shoe, comprising a sole, a cover connected to the sole and comprising an opening, and a fastener connected to the cover that reversibly narrows the opening. The sole makes contact with the cleats of the shoe to prevent the cleats from making contact with the ground. In some embodiments, the cleats align with a cavity in the sole to provide for a safe and secure fit between the shoe and the shoe cover. This fit between the cleat and the cavity prevents the cleated shoe from sliding either forward or backward while the wearer is running or engaging in sporting activities, for example. The cover is connected to the sole and can wrap around the shoe. The fastener reversibly narrows the opening and, in some embodiments, increases tension between the shoe cover and the cleated shoe, such that the cleated shoe is secured within the shoe cover. By securing the cleated shoe in the shoe cover, the wearer is able to safely run or engage in sporting activities. In some embodiments, the fastener increases the tension between the upper region of the cover and the cleated shoe, and also increases the tension between the opening region and the cleated shoe. In combination, the fastener's ability to increase the tension at both of these locations provide for a safer and more secure fit for the cleated shoe within the shoe cover than increasing tension at only one of these locations could typically provide. For example, increasing the tension between the upper region of the cover and the cleated shoe can prevent the cleated shoe from sliding either forward or backward relative to the sole while the wearer is running or engaging in sporting activities by ensuring that the cleats of the cleated shoe cover remain tightly held against the sole, the upper region, and/or the cavities of the shoe cover. Moreover, increasing the tension between the opening region of the cover, e.g., the rear end of the opening region, and the cleated shoe can prevent the cleated shoe from sliding either forward or backward relative to the sole while the wearer is running or engaging in sporting activities by providing a secure fit at this region of the cleated shoe and the shoe cover, and this also provides the benefit, in some embodiments, of covering the cleated shoe to prevent elements such as dirt, mud, water, etc. from contacting the cleated shoe.

In some of any such embodiments, the fastener is a drawstring fastener and comprises a string and a cord lock. In some of any such embodiments, the string is an elastic string.

In some of any such embodiments the cover comprises an upper region, a left side, and a right side, and the string crosses over the upper region of the cover from the left side to the right side and/or from the right side to the left side.

In some of any such embodiments, the string crosses over the upper region of the cover from the left side to the right side and/or from the right side to the left side at least two times. In some of any such embodiments, the string crosses over the upper region of the cover from the left side to the right side and/or from the right side to the left side at least three times.

In some of any such embodiments, the cover comprises an opening region that surrounds the opening, and wherein the string passes along the opening region. In some of any such embodiments, the opening region comprises a perimeter around the opening and the string passes along at least 20%, at least 30%, at least 40%, at least 50%, at least 60%, at least 70%, at least 80%, at least 90%, or at least 95% of the perimeter. In some of any such embodiments, the cover comprises a rear side along the opening and the string passes along the rear side. In some of any such embodiments, the shoe cover covers at least 50%, at least 55%, at least 60%, at least 65%, at least 70%, at least 75%, at least 80%, at least 85%, at least 90%, at least 91%, at least 92%, at least 93%, at least 94%, at least 95%, at least 96%, at least 97%, at least 98%, at least 99%, or 100% of the outer surface area of the cleated shoe when the cleated shoe is properly inserted into the shoe cover and the fastener is tightened. In some of any such embodiments, when the cleated shoe is properly inserted into the shoe cover and the fastener is tightened, the fastener increases tension between the upper region of the cover and the cleated shoe, increases tension between the rear side and the cleated shoe, and narrows the opening.

In some of any such embodiments, the sole comprises a lower sole and an upper sole. In some of any such embodiments, the upper sole comprises a material selected from the group consisting of elastomeric material and foam material. In some of any such embodiments, the shoe cover further comprises a sole insert. In some of any such embodiments, the sole comprises a lower sole and the sole insert comprises an upper sole. In some of any such embodiments, the sole insert and the shoe cover are reversibly attached. In some of any such embodiments, the sole insert is attached to the shoe cover using an adhesive.

In some of any such embodiments, the shoe cover further comprises a sole insert casing that encompasses the sole insert. In some of any such embodiments, the sole insert casing comprises a heat-resistant elastomeric material. In some of any such embodiments, the sole insert comprises a perimeter and a bottom and the sole insert casing surrounds the perimeter of the sole insert and covers the bottom of the sole insert. In some of any such embodiments, the sole insert casing and the shoe cover are reversibly attached. In some of any such embodiments, the sole insert casing is attached to the shoe cover using an adhesive.

In some of any such embodiments, the sole insert comprises a material selected from the group consisting of elastomeric material and foam material. In some of any such embodiments, the elastomeric material is a silicone rubber material. In some of any such embodiments, the elastomeric material is a silicone rubber material. In some of any such embodiments, the upper sole comprises a thermoplastic polymer material. In some of any such embodiments, the sole insert comprises a thermoplastic polymer material. In some of any such embodiments, the thermoplastic polymer material becomes moldable when heated to a sufficiently elevated temperature. In some of any such embodiments, the elastomeric material comprises a cavity that aligns with a cleat protruding from the cleated shoe when the cleated shoe is properly inserted into the shoe cover. In some of any such embodiments, the thermoplastic polymer material comprises a cavity that aligns with a cleat protruding from the cleated shoe when the cleated shoe is properly inserted into the shoe cover.

In some of any such embodiments, the cavity is formed by a process of contacting the cleat of the cleated shoe with the elastomeric material. In some of any such embodiments, the process of contacting the cleat of the cleated shoe with the elastomeric material is performed while the elastomeric material is in an uncured state. In some of any such embodiments, wherein the cavity is formed by a process of contacting the cleat of the cleated shoe with the thermoplastic polymer material. In some of any such embodiments, the process of contacting the cleat of the cleated shoe with the thermoplastic polymer material is performed while the thermoplastic polymer material is in a moldable state after being heated to a sufficiently elevated temperature. In some of any such embodiments, each cavity aligns with no more than one cleat of the cleated shoe. In some of any such embodiments, each cavity aligns with no more than one cleat of the cleated shoe.

In some of any such embodiments, the sole is positioned between a toe end and a heel end of the shoe cover, and the cover extends from the toe end of the shoe cover to the heel end of the shoe cover. In some of any such embodiments, the cover comprises a material selected from the group consisting of elastic material, elastomeric material, elasticized fabric, and mesh material.

Also provided herein is a method for covering a cleated shoe using a shoe cover, the method comprising: inserting a cleated shoe into the shoe cover of any one of the embodiments provided herein; and tightening the fastener. In some of any such embodiments, the cleated shoe is an athletic shoe selected from the group consisting of soccer shoes, football shoes, track & field shoes, baseball shoes, softball shoes, rugby shoes, cycling shoes, lacrosse shoes, and golf shoes. In some of any such embodiments, the cleated shoe is a boot. In some of any such embodiments, the cleated shoe comprises a cleat and the shoe cover comprises a cavity, and each cavity aligns with no more than one cleat of the shoe when the cleated shoe is inserted into the shoe cover.

Also provided herein is a method for forming a cleat pattern in a shoe cover, the method comprising: obtaining the shoe cover of any of the embodiments provided herein; obtaining a cleated shoe having a cleat pattern formed by one or more cleats; adding an elastomeric material in an uncured state to the sole; contacting the one or more cleats of the cleated shoe with the elastomeric material while the elastomeric material is in an uncured state; and curing the elastomeric material. In some of any such embodiments, the elastomeric material is a silicone rubber material.

Also provided herein is a method for forming a cleat pattern in a shoe cover, the method comprising: obtaining the shoe cover of any of the embodiments provided herein; obtaining a cleated shoe having a cleat pattern formed by one or more cleats; obtaining a sole insert casing; adding an elastomeric material in an uncured state to the sole insert casing; contacting the one or more cleats of the cleated shoe with the elastomeric material while the elastomeric material is in an uncured state; and curing the elastomeric material. In some of any such embodiments, the elastomeric material is a silicone rubber material.

Also provided herein is a method for forming a cleat pattern in a shoe cover, the method comprising: obtaining the shoe cover of any of the embodiments provided herein; obtaining a cleated shoe having a cleat pattern formed by one or more cleats; obtaining a sole insert comprising an elastomeric material in an uncured state; contacting the one or more cleats of the cleated shoe with the elastomeric material while the elastomeric material is in an uncured state; and curing the elastomeric material.

Also provided herein is a method for forming a cleat pattern in a shoe cover, the method comprising: obtaining the shoe cover of any of the embodiments provided herein; obtaining a cleated shoe having a cleat pattern formed by one or more cleats; obtaining a sole insert comprising a thermoplastic polymer material in a moldable state; contacting the one or more cleats of the cleated shoe with the thermoplastic polymer material while the thermoplastic polymer material is in the moldable state; and allowing the thermoplastic polymer material to harden. In some of any such embodiments, the thermoplastic polymer material is in a moldable state after being heated to a sufficiently elevated temperature.

Also provided herein is a method for manufacturing a shoe cover for use with a cleated shoe, the method comprising: providing a sole; connecting a cover to the sole; and providing a fastener that reversibly narrows an opening in the cover.

Also provided herein is a kit comprising a pair of shoe covers, the kit comprising a pair of the shoe covers of any one of the embodiments provided herein, wherein the pair comprises a shoe cover configured to cover a left shoe and a shoe cover configured to cover a right shoe.

Also provided herein is a kit comprising a pair of shoe covers, the kit comprising: a pair of the shoe cover of any of the embodiments provided herein; and an elastomeric material in an uncured state, wherein the pair comprises a shoe cover configured to cover a left shoe and a shoe cover configured to cover a right shoe. In some of any such embodiments, the elastomeric material is provided within a container selected from the group consisting of a tube, vile, syringe, bottle, can, and tub. In some of any such embodiments, the elastomeric material is a silicone rubber material.

Also provided herein is a kit comprising a pair of shoe covers, the kit comprising: a pair of the shoe cover of any of the embodiments provided herein; and a sole insert comprising an elastomeric material in an uncured state, wherein the pair comprises a shoe cover configured to cover a left shoe and a shoe cover configured to cover a right shoe. In some of any such embodiments, the elastomeric material is a silicone rubber material.

Also provided herein is a kit comprising a pair of shoe covers, the kit comprising: a pair of the shoe cover of any of the embodiments provided herein; and a sole insert comprising a thermoplastic polymer material that becomes moldable at a sufficiently elevated temperature, wherein the pair comprises a shoe cover configured to cover a left shoe and a shoe cover configured to cover a right shoe.

Also provided herein is a kit comprising: a sole insert casing; and an elastomeric material in an uncured state.

Also provided herein is a kit comprising a sole insert comprising an elastomeric material in an uncured state.

Also provided herein is a kit comprising a sole insert comprising an elastomeric material that comprises a cavity.

Also provided herein is a kit comprising: a sole insert casing; and a thermoplastic polymer material that becomes moldable at a sufficiently elevated temperature.

Also provided herein is a kit comprising a sole insert comprising a thermoplastic polymer material that becomes moldable at a sufficiently elevated temperature.

BRIEF DESCRIPTION OF THE DRAWINGS

FIG. 2A depicts an embodiment of the upper sole that comprises a silicone rubber material.

FIG. 4A depicts an embodiment of the first fastener 112 that reversibly connected the first cover 104 and the second cover 106 at the heel end 116. FIG. 4B depicts an embodiment of the second fastener 114 capable of reversibly connecting the first cover 104 and the second cover 106 at the toe end 118 by including an engagement region 126 that comprises a loop-compatible hook material on the second fastener 114 and by including an attachment region 128 that comprises a hook-compatible loop material on the first cover 104. FIG. 4B also provides a representation of an exemplary positioning of the second fastener 114 relative to the cleated shoe 130 when the cleated shoe 130.

FIG. 5A depicts an embodiment of the sole insert 120 that comprises the upper sole 108 and a cavity 110 at multiple locations on the upper sole 108. The sole insert of the FIG. 5A embodiment is configured to be reversibly attached to the shoe cover by being capable of being inserted into the shoe cover and removed from the shoe cover. FIG. 5B depicts an embodiment of the sole insert casing 122 that includes a support member 124 at multiple locations on the sole insert casing 122.

FIG. 6A depicts the shoe cover in a configuration where the fastener is tightened, and FIG. 6B depicts the shoe cover in a configuration where the fastener is loosened.

FIG. 6A depicts the shoe cover in a configuration where the fastener is loosened, and FIG. 6B depicts the shoe cover in a configuration where the fastener is tightened.

DETAILED DESCRIPTION

The shoe covers and methods described herein advantageously provide for the prolonged lifespan of cleated shoes while allowing the wearer to run or engage in sporting activities.

The present disclosure provides a shoe cover for use with a cleated shoe that includes a sole, a first cover, a second cover, a first fastener, and a second fastener. Embodiments of the shoe cover described herein are especially suitable for athletic footwear that have cleats to provide, for example, traction. Some embodiments include a sole that is molded with a cavity to align with the cleat pattern of the cleated shoe for a safe and secure fit. The first fastener provides for a secure fit of the shoe cover to the cleated shoe at the heel region and the second fastener provides a safe and secure fit of the shoe cover to the cleated shoe at the toe region. Some embodiments allow the wearer to run or engage in sporting activities by providing for a safe and secure fit through a molded sole, a first cover, a second, cover, a first fastener connecting the first and second cover at a heel region of the shoe, and the second fastener connecting the first and second cover at a toe region of the shoe. The shoe covers described herein include shoe covers configured to be shoe covers for a cleated shoe intended to be worn on the left foot, and shoe covers configured to be shoe covers for a cleated shoe intended to be worn on the right foot.

Figure 1A:
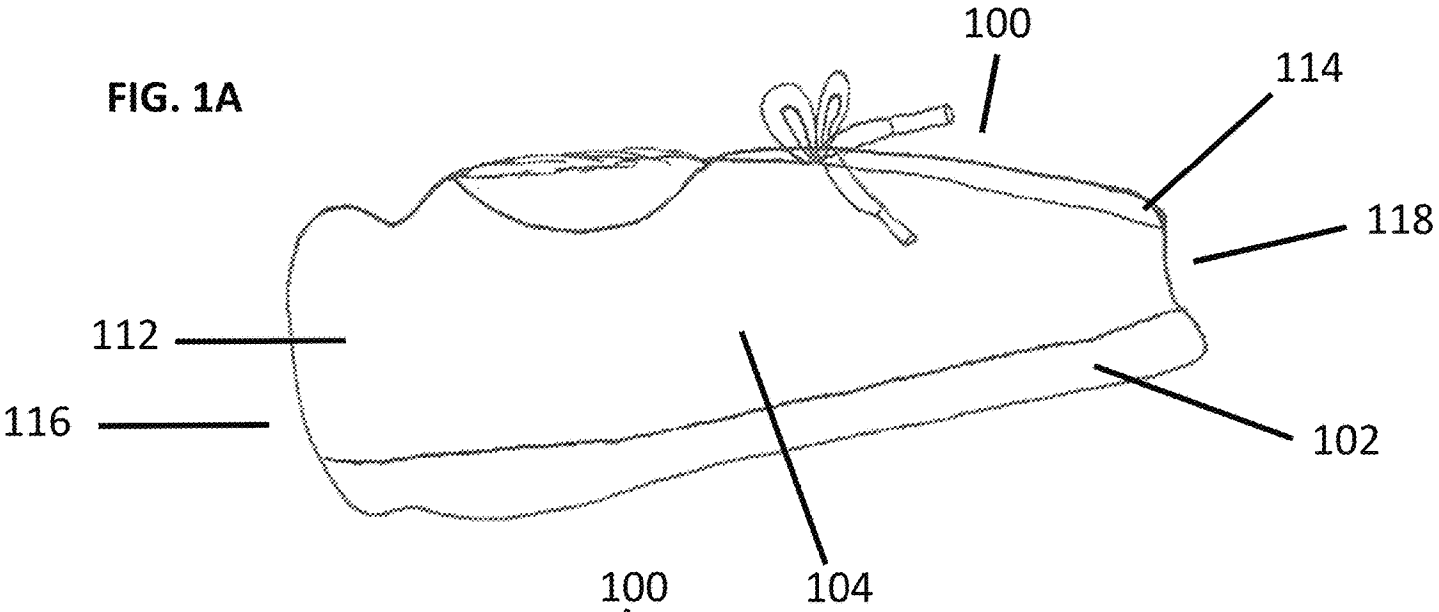
FIG. 1A and FIG. 1B depict an embodiment of the shoe cover 100 with exemplary components identified. This representation depicts the shoe cover 100 covering a cleated shoe.
Figure 1B:
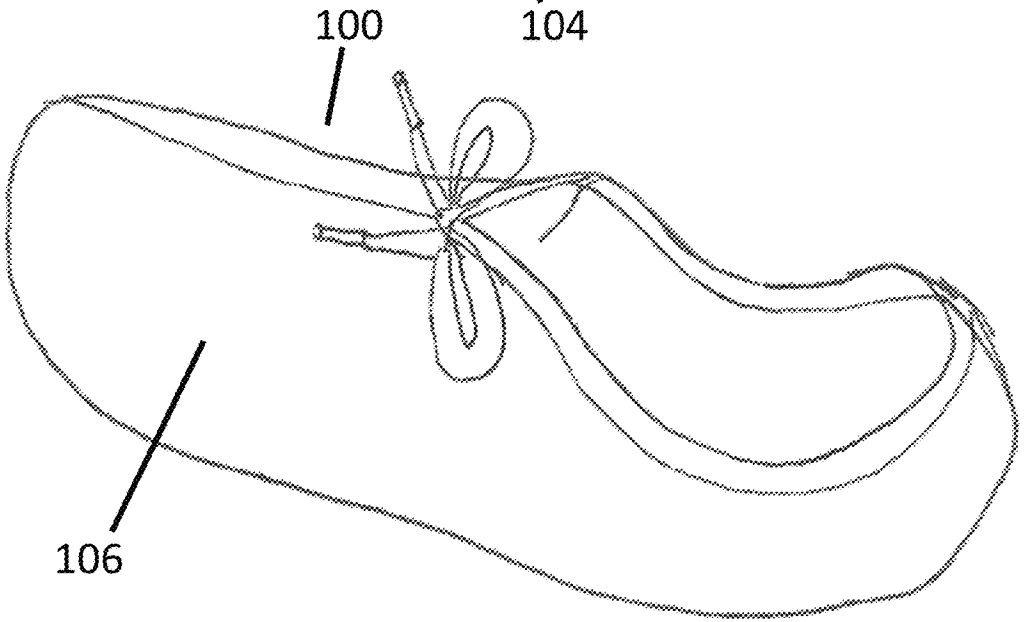

Turning now to the drawings, FIG. 1A and FIG. 1B depict an embodiment of a shoe cover 100 having a toe end 118 and a heel end 116 for use with a cleated shoe. The shoe cover 100 includes a sole 102, a first cover 104, a second cover 106, a first fastener 112 at the heel end that reversibly connects the first cover 104 and the second cover 106, and a second fastener 114 at the toe end that reversibly connects the first cover 104 and the second cover 106. The first fastener 112 and the second fastener 114 provide for a secure fit suitable for active use by ensuring that the heel end of the cleated shoe and the heel end 116 of the shoe cover 100 are secured tightly together and that the toe end of the cleated shoe and the toe end 118 of the shoe cover 100 are secured tightly together. The sole 102 is connected to the first cover 104 and the second cover 106.

In some embodiments, the shoe cover comprises a heel end and a toe end. In some embodiments, the sole includes a toe region and a heel region. The toe region of the sole is situated at the toe end of the shoe cover. The toe end of the shoe cover is the end of the shoe cover that is proximal to the location where the toes of the wearer's foot would be present when the shoe cover is properly worn. The heel region of the sole is situated at the heel end of the shoe cover. The heel end of the shoe cover is the end of the shoe cover that is proximal to the location where the heel of the wearer's foot would be present when the shoe cover is properly worn. In some embodiments, the sole comprises an elastomeric material. In some embodiments, the elastomeric material of the sole is selected from the group consisting of natural polymers, synthetic polymers, and polymer blends. In some embodiments, the elastomeric material of the sole is selected from the group consisting of natural rubber, synthetic rubber, polyurethane, and polyvinyl chloride. In some embodiments, the elastomeric material of the sole includes a silicone rubber material. In some embodiments, the sole comprises a foam material. In some embodiments, the sole comprises a thermoplastic polymer material.

In some embodiments, the sole includes a material that has been molded to substantially conform to the cleat pattern of the cleated shoe. In some embodiments, a "cleat pattern" is the pattern created by the size and shape of a cleat of a shoe, the location of a cleat of the shoe on the underside of the shoe, and the proximity of the cleats to one another when there is more than one cleat. In some embodiments, the "cleat pattern" comprises only the cleats of the cleated shoe that are of at least a certain length, such as at least 1/16", at least 1/8", at least 1/6", at least 1/5", at least 1/4", at least 1/3", or at least 1/2" in length.

In some embodiments, the sole includes a silicone rubber material that has been molded to substantially conform to the cleat pattern of the cleated shoe. In some embodiments, the sole includes a thermoplastic polymer material that has been molded to substantially conform to the cleat pattern of the cleated shoe. It is understood that, in some embodiments, not every cleat of the cleat pattern of the cleated shoe will be molded into the sole. For instance, in some embodiments, a cleated shoe may have cleats that are of two or more lengths, where some of the cleats having shorter lengths are not molded into the sole of the shoe cover. As such, in some embodiments, the cleats of a cleat pattern of a cleated shoe that are molded into the sole comprises the cleat(s) that are of at least a certain length, such as at least 1/16", at least 1/8", at least 1/6", at least 1/5", at least 1/4", at least 1/3", or at least 1/2" in length.

In some embodiments, the molding of the sole is performed by the manufacturer or distributor of the shoe cover. In some embodiments, the molding of the sole is performed by the consumer of the shoe cover. In some embodiments, the molding of the sole is permanent. In some embodiments, the molding of the sole is permanent unless the sole is exposed to conditions, e.g., a sufficiently elevated temperature, that cause the sole to change into a moldable state. In some embodiments, the molding of the sole is temporary. In some embodiments, the sole includes a cavity that aligns with a cleat protruding from a cleated shoe when the cleated shoe is properly inserted into the shoe cover. The cavity of the sole forms a cavity pattern in the sole. In some embodiments, a "cavity pattern" is the pattern created by the size and shape of the cavity, the location of the cavity, and the proximity of the cavities to one another when there is more than one cavity.

Figure 2A:
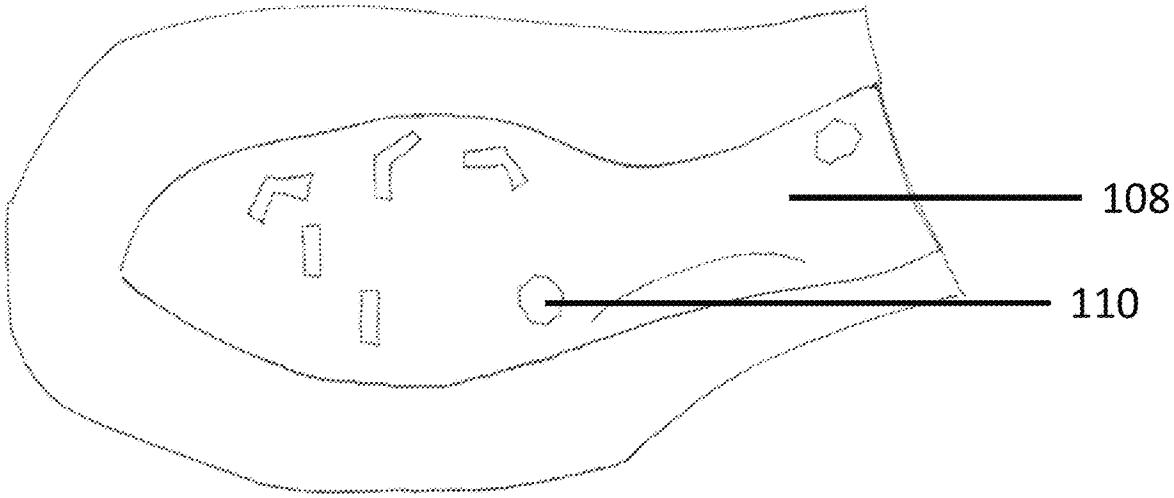
FIG. 2A depicts an embodiment of the upper sole 108 comprising a cavity 110 at multiple locations on the upper sole 108.
Figure 2B:
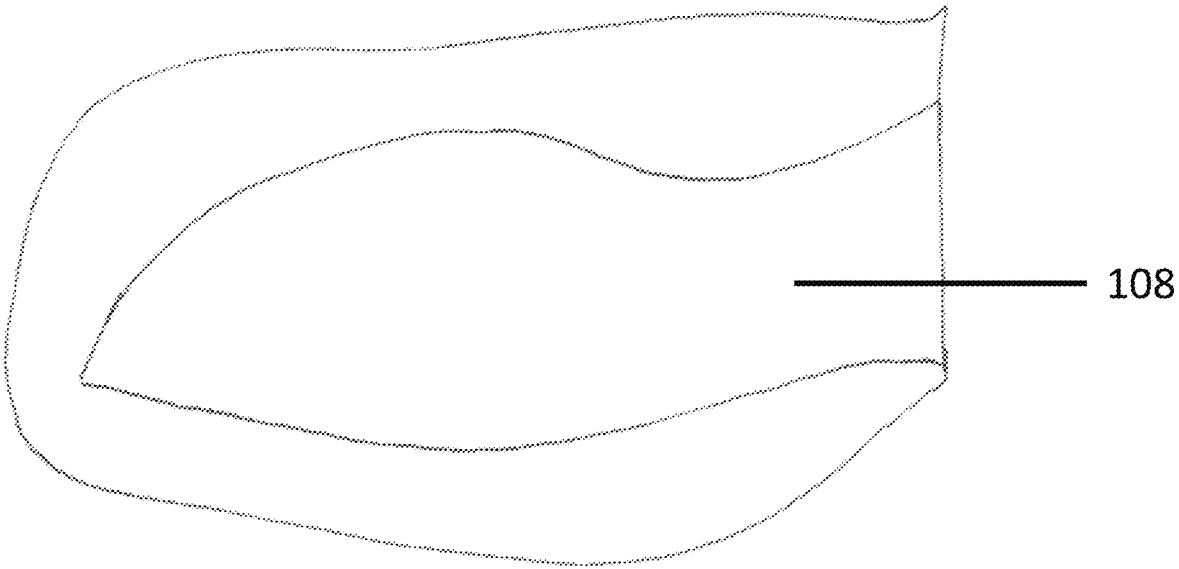
FIG. 2B depicts an embodiment of the upper sole 108 that comprises a foam material.

In some embodiments, the sole includes a lower sole and an upper sole, where the lower sole makes contact with the ground and the upper sole makes contact with the cleated shoe. FIGS. 2A and 2B, for example, depict a shoe cover 100 with an upper sole 108. The upper sole includes the portion of the sole that makes contact with the cleated shoe. In some embodiments, the upper sole is molded to include a cavity pattern that aligns with the cleat pattern of a cleated shoe. In some embodiments, the upper sole is molded to include a cavity pattern that aligns with the cleats of a cleated shoe that are of at least a certain length, such as at least 1/16", at least 1/8", at least 1/6", at least 1/5", at least 1/4", at least 1/3", or at least 1/2" in length. The cavity pattern is formed by, for example, the size, shape, location, and relative positioning of a cavity 110, or the size, shape, location, and relative positioning of a cavity 110 at multiple locations, as shown, for example, in FIG. 2A. The alignment of the cleats of a cleated shoe to the cavities of the sole 102 allows the cleated shoe to fit securely into the shoe cover 100. This allows the wearer to run or engage in sporting activities because the cleated shoe is securely connected to the sole of the shoe cover 100, which prevents the cleated shoe from sliding forward, backward, or to the side, relative to its proper positioning on the sole 102. In some embodiments, the upper sole comprises a foam material as shown, for example, in FIG. 2B. The foam material in the upper sole of some embodiments is suitable for conforming to the cleat pattern of the cleated shoe such that it prevents the cleated shoe from sliding forward, backward, or to the side, relative to its proper positioning on the sole 102. This foam material also provides shock absorption for the wearer of the shoe cover. By comprising a foam material, the upper sole also has the advantage in that it may be used with a variety of different cleated shoes each having a different cleat pattern because of the ability of the foam material to conform to each cleat pattern as force from the cleated shoe is applied to the foam material.

In some embodiments, the lower sole includes a toe region and a heel region. The toe region of the lower sole is situated at the toe end of the shoe cover. The heel region of the lower sole is situated at the heel end of the shoe cover. The lower sole can include any material suitable for use in making contact with the ground, or for providing shock absorption for the wearer of the shoe cover. In some embodiments, the lower sole is comprised of an elastomeric material. In some embodiments, the elastomeric material of the lower sole is selected from the group consisting of natural polymers, synthetic polymers, and polymer blends. In some embodiments, the elastomeric material of the lower sole is selected from the group consisting of natural rubber, synthetic rubber, polyurethane, and polyvinyl chloride. In some embodiments, the elastomeric material of the lower sole includes a silicone rubber material.

In some embodiments, the upper sole includes a toe region and a heel region. The toe region of the upper sole is situated at the toe end of the shoe cover. The heel region of the upper sole is situated at the heel end of the shoe cover. In some embodiments, the upper sole is configured to be removable from the shoe cover. In some embodiments, the upper sole is configured to be non-removable from the shoe cover. In some embodiments, the upper sole and the lower sole are distinct layers. In some embodiments, the sole includes an upper sole and a lower sole molded together. In some embodiments, the sole includes an upper sole and a lower sole that that are formed of the same material.

Figure 5A:
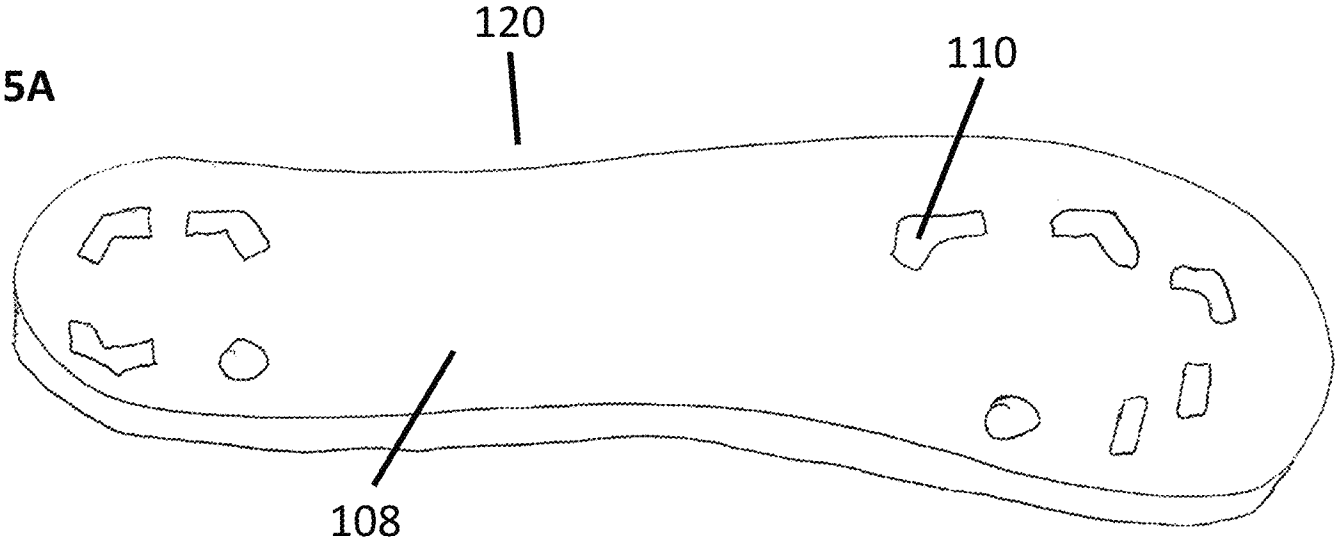
FIG. 5A and FIG. 5B depict embodiments of the sole insert 120 and the sole insert casing 122, respectively.

In some embodiments, the shoe cover further includes a sole insert. In some embodiments, the sole insert includes the upper sole. In some embodiments, the sole insert is the upper sole, such as any of the upper soles described herein. In some embodiments, the sole insert is any of the upper soles described herein, except in that the sole insert is, in some embodiments, removable from the shoe cover and/or inserted into the shoe cover by the consumer. FIG. 5A, for example, depicts an embodiment of a sole insert 120 that is removable from the shoe cover 100 and comprises an upper sole 108 and a cavity 110. As such, reference to the "upper sole" herein includes reference to an embodiment of the upper sole that is further configured to be removable from the shoe cover and/or to be inserted into the shoe cover by the consumer (termed the "sole insert"). In some embodiments, the sole insert is at least a part of the upper sole. In some embodiments, the sole insert is an elastomeric material or a foam material. In some embodiments, the sole insert includes an elastomeric material or a foam material. In some embodiments, the sole insert is an upper sole that comprises an elastomeric material or a foam material. In some embodiments, the foam material is an open cell foam. In some embodiments, the foam material is a closed cell foam. In some embodiments, the foam material is or comprises a polyurethane foam material. In some embodiments, the foam material is selected from the group consisting of open-celled polyether polyurethane foam, partially open-celled polyether polyurethane foam, reticulated polyurethane foam, high-resiliency polyether polyurethane foam, open-celled viscoelastic polyether polyurethane foam, partially open-celled viscoelastic polyether polyurethane foam, open-celled polyester polyurethane foam, partially open-celled polyester polyurethane foam, open-celled polyester foam, partially open-celled polyester foam, latex foam, melamine foam, and combinations thereof. In some embodiments, the elastomeric material of the sole insert is selected from the group consisting of natural polymers, synthetic polymers, and polymer blends. In some embodiments, the elastomeric material of the sole insert is selected from the group consisting of natural rubber, synthetic rubber, polyurethane, and polyvinyl chloride. In some embodiments, the elastomeric material of the sole insert includes a silicone rubber material. In some embodiments, the sole insert includes a material selected from the group consisting of acrylonitrile butadiene styrene, polyethylene, polycarbonate, polyamide, high impact polystyrene, polypropylene, fluoropolymer, and polyvinyl chloride. In some embodiments, the sole insert is or comprises a thermoplastic polymer material. The sole insert can be configured for use in a shoe cover configured for used with either the left foot or the right foot.

Figure 5B:
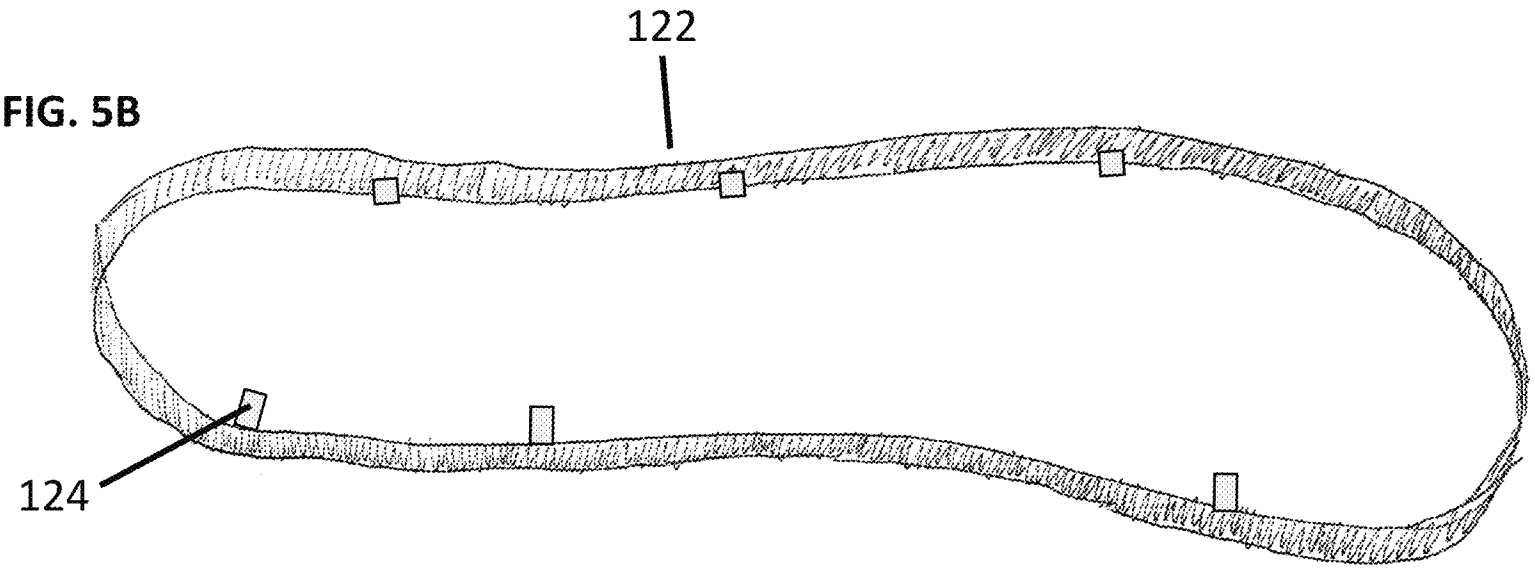
Figure 8:
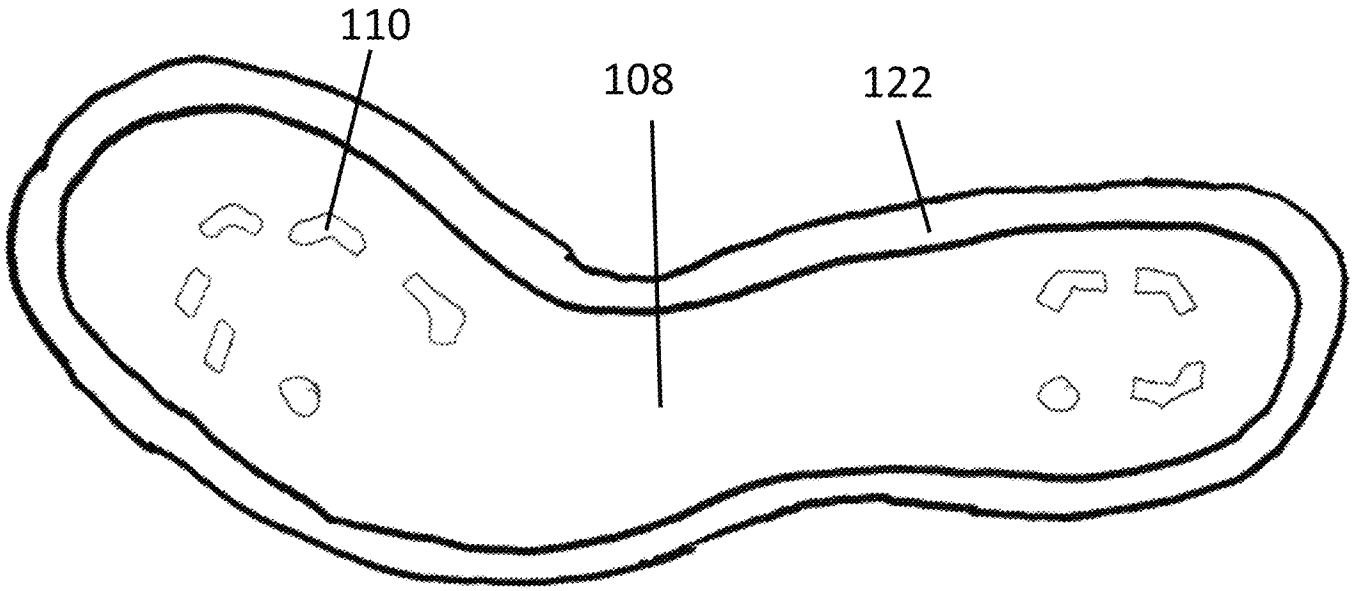
FIG. 8 depicts an embodiment of the sole insert casing 122 and the sole insert 120 that includes the upper sole 108, where the sole insert casing 122 surrounds the perimeter and base of the upper sole with a heat-resistant material, while the upper sole 108 includes a thermoplastic polymer material. The upper sole includes a cavity 110 that was formed by molding the thermoplastic polymer material to align with a cleat of the cleated shoe.

In some embodiments, the sole insert is situated within a sole insert casing. The sole insert casing, in some embodiments, is a structure that encompasses the sole insert and/or the upper sole. FIG. 5B, for example, depicts an embodiment of a sole insert casing 122 that is a structure designed to encompass the sole insert 120, including the upper sole 108. The sole insert casing of FIG. 5B can be used, for instance, when a manufacturer, distributor, or consumer forms an upper sole that comprises a cavity pattern that aligns with the cleat pattern of a particular cleated shoe, such as by adding an elastomeric material in an uncured state to the sole insert casing 122, then contacting the cleat pattern of a cleated shoe with the elastomeric material, and then fully curing the elastomeric material by methods known in the art. In some embodiments, the sole insert casing surrounds the perimeter of the sole insert and covers the entire bottom of the sole insert. By surrounding the perimeter of the sole insert and covering the entire bottom of the sole insert, a sole insert casing of this embodiment ensures that the sole insert maintains its shape if, for instance, it is sufficiently heated such that the sole insert changes into a moldable state, such as by becoming liquid and/or pliable, and is contacted by a cleat(s) of a cleated shoe to form a cavity pattern. In some embodiments, the sole insert casing comprises a heat-resistant material, such as a heat-resistant elastomeric material. In some embodiments, the sole insert casing comprises a heat-resistant material (e.g., a heat-resistant elastomeric material) and the sole insert comprises a thermoplastic polymer material. For instance, FIG. 8 depicts an embodiment of a sole insert casing 122 that includes a heat-resistant elastomeric material, and a sole insert 120 that includes an upper sole 108 that includes a thermoplastic polymer material. The use of a sole insert casing 122 that is heat-resistant allows for the sole insert casing to retain its shape while the sole insert that includes the upper sole 108 is heated to a sufficiently elevated temperature such that it changes into a moldable state.

In some embodiments, the sole insert casing comprises a support member that engages with the sole insert and/or the upper sole. The support member promotes, maintains, or otherwise facilitates the connection between the sole insert and the sole insert casing. In some embodiments, the support member protrudes inward from the sole insert casing such that it engages with the sole insert or a component thereof (e.g., the elastomeric material or foam material). The support member can take various forms consistent with the purpose of promoting, maintaining, or otherwise facilitating the connection between the sole insert and the sole insert casing. In some embodiments, the support member can be any structure that protrudes inward from the sole insert casing and engages with the sole insert or a component thereof (e.g., the elastomeric material, thermoplastic polymer material, or foam material). In some embodiments, the support member is selected from the group consisting of a ledge, a rod, a bar, a wire, a mesh, a shaft, and a peg. FIG. 5B, for example, depicts a sole insert casing that comprises a support member 124 at multiple locations around the perimeter of the sole insert casing. In this embodiment, the support member 124 is a peg that protrudes inward from the sole insert casing such that when an elastomeric material, for example, is added to the sole insert casing and is fully cured into a solid state, the support member 124 promotes, maintains, or otherwise facilitates the connection between the elastomeric material and the sole insert casing by anchoring the cured elastomeric material to the sole insert casing. The sole insert casing can be configured for use in a shoe cover configured for used with either the left foot or the right foot.

In some embodiments, sole insert casing is removed prior to the attachment of the sole insert to the shoe cover. In some embodiments, the sole insert casing is not removed from the sole insert when the sole insert and/or the sole insert casing is attached to the shoe cover.

In some embodiments, the sole insert casing is a structure that facilitates the attachment of the sole insert to the shoe cover. In some embodiments, the sole insert casing is a structure that wraps around the perimeter of the upper sole and includes a reversible attachment mechanism that facilitates the reversible attachment of the sole insert to the shoe cover. In some embodiments, the sole insert casing is a structure to which the upper sole is added, such that the sole insert casing forms a border around the edges of the upper sole with the top of the upper sole and the bottom of the upper sole exposed. In some embodiments, the sole insert casing is a structure to which the sole insert is added, such that the sole insert casing forms a border around the edges of the sole insert with the top of the sole insert and the bottom of the sole insert exposed. This can be accomplished, for instance, by adding an elastomeric material to the sole insert casing while the sole insert casing is placed firmly on a flat surface. This can also be accomplished by attaching a removable base to the bottom of the sole insert that can be removed during the curing process or following the completion of the curing process. In some embodiments, the sole insert casing is a structure to which the sole insert is added, such that the sole insert casing forms a border around the edges of the sole insert with the top of the sole insert exposed and the bottom of the sole insert covered.

The sole insert may, in some embodiments, be removable, which allows the wearer of the shoe cover to reversibly attach a sole insert comprising an upper sole having a cavity pattern that aligns with the cleat pattern of the wearer's cleated shoes. Thus, in some embodiments, the wearer may have multiple sole inserts, each with its own cavity pattern, for use with the same shoe cover. In some embodiments, the sole insert is configured to reversibly attach to the shoe cover. In some embodiments, the sole insert casing is configured to reversibly attach to the shoe cover. In some embodiments, the shoe cover is configured to reversibly attach to the sole insert and/or the sole insert casing. The reversible attachment of the sole insert and/or the sole insert casing to the shoe cover, or the shoe cover to the sole insert and/or the sole insert casing, can be achieved by any reversible attachment mechanism, such as by the use of a locking clip, a nut and bolt fastener, or by hook and loop fasteners, or by configuring the shoe cover and the sole insert and/or the sole insert casing such that the sole insert and/or the sole insert casing can be securely held in place in the shoe cover due to a tight fit.

In some embodiments, the sole insert and/or the sole insert casing is configured to irreversibly attach to the shoe cover. The irreversible attachment of the sole insert and/or the sole insert casing to the shoe cover can be achieved by any irreversible attachment mechanism, such as by the use of adhesive that binds the sole insert and/or the sole insert casing to the shoe cover. In some embodiments, the sole insert and/or the sole insert casing is irreversibly attached to the shoe cover by the manufacturer or distributor of the shoe cover. In some embodiments, the sole insert and/or the sole insert casing is irreversibly attached to the shoe cover by the consumer of the shoe cover. In some embodiments, the sole insert casing and/or the sole insert is irreversibly attached to the shoe cover using an adhesive. The adhesive can be any adhesive suitable for providing a secure, durable, and long-lasting attachment. In some embodiments, the adhesive is a cement adhesive. In some embodiments, the cement adhesive is a contact cement. In some embodiments, the cement adhesive is a waterproof cement adhesive. In some embodiments, the cement adhesive comprises n-propyl acetate, heptane, and methyl acetate. In some embodiments, the cement adhesive comprises toluene, heptane, and ethyl acetate. In some embodiments, the cement adhesive comprises methyl ethyl ketone, cyclohexane, and acetone. In some embodiments, the adhesive is a glue.

In some embodiments, the sole insert is connected to a sole insert casing that is configured to reversibly attach to the shoe cover. In some embodiments, the sole insert is configured to reversibly attach the sole insert to the sole insert casing. In some embodiments, the sole insert is configured to irreversibly attach the sole insert to the sole insert casing. Thus, in some embodiments, the sole insert is designed to be removable by reversible attachment from the shoe cover so that a sole insert comprising an upper sole with a different cavity pattern can be used with the same shoe cover. The reversible attachment of the sole insert to the shoe cover can be achieved by any reversible attachment mechanism, such as by the use of a locking clip, a nut and bolt fastener, or by hook and loop fasteners, or by configuring the sole insert and the shoe cover such that the sole insert and/or the sole insert casing can be securely held in place in the shoe cover due to a tight fit. In some embodiments, the sole insert casing is reversibly attached to the shoe cover by the manufacturer or distributor of the shoe cover. In some embodiments, the sole insert casing is reversibly attached to the shoe cover by the consumer of the shoe cover. In some embodiments, the shoe cover is reversibly attached to the sole insert casing by the manufacturer or distributor of the shoe cover. In some embodiments, the shoe cover is reversibly attached to the sole insert casing by the consumer of the shoe cover. For instance, in some embodiments, the consumer can purchase a sole insert and/or a sole insert casing to be reversibly attached to the shoe cover that the consumer previously obtained or will obtain in the future. In some embodiments, the ability to remove the sole insert, or the sole insert casing comprising the sole insert, or the sole insert from the sole insert casing, from the shoe cover allows the consumer to utilize the same shoe cover with two or more different cleated shoes, such as a soccer shoe with a first cleat pattern and a baseball shoe with a second cleat pattern. By removing the sole insert from the shoe cover, or the sole insert casing comprising the sole insert from the shoe cover, or the sole insert from the sole insert casing, a different sole insert, or a different sole insert casing comprising the sole insert, can be reversibly attached to the shoe cover or the sole insert casing. This reduces cost to the consumer by being able to use a single pair of shoe covers with multiple different cleats. For instance, depending on the particular type of cleated shoes the consumer intends on wearing, the consumer can attach the sole insert, or the sole insert casing comprising a sole insert, that is compatible with the cleat pattern of the cleated shoes to be worn. This also reduces the amount of space that would be needed to store, or travel with, multiple pairs of shoe covers.

The upper sole can include any material suitable for use in protecting the sole of the cleated shoe, conforming to the cleat pattern of the cleated shoe, or providing shock absorption for the wearer of the cleated shoe, or a combination thereof. In some embodiments, the upper sole is comprised of an elastomeric material. In some embodiments, the upper sole is comprised of a foam material. In some embodiments, the foam material is an open cell foam. In some embodiments, the foam material is a closed cell foam. In some embodiments, the foam material is or comprises a polyurethane foam material. In some embodiments, the foam material is selected from the group consisting of open-celled polyether polyurethane foam, partially open-celled polyether polyurethane foam, reticulated polyurethane foam, high-resiliency polyether polyurethane foam, open-celled viscoelastic polyether polyurethane foam, partially open-celled viscoelastic polyether polyurethane foam, open-celled polyester polyurethane foam, partially open-celled polyester polyurethane foam, open-celled polyester foam, partially open-celled polyester foam, latex foam, melamine foam, and combinations thereof. In some embodiments, the elastomeric material of the upper sole is selected from the group consisting of natural polymers, synthetic polymers, and polymer blends. In some embodiments, the elastomeric material of the upper sole is selected from the group consisting of natural rubber, synthetic rubber, polyurethane, and polyvinyl chloride. In some embodiments, the elastomeric material of the upper sole includes a silicone rubber material. In some embodiments, the upper sole includes a material selected from the group consisting of acrylonitrile butadiene styrene, polyethylene, polycarbonate, polyamide, high impact polystyrene, polypropylene, fluoropolymer, and polyvinyl chloride.

In some embodiments, the upper sole is or comprises a thermoplastic polymer material. In some embodiments, the upper sole is or comprises a thermoplastic polymer material that changes into a moldable state after heating the thermoplastic polymer material to a sufficiently elevated temperature. It is to be understood that a "thermoplastic polymer" is to be construed as including thermoplastic co-polymers, such as a copolymer of ethylene and vinyl acetate. The thermoplastic polymer material can, in some embodiments, be any thermoplastic polymer material that changes into a moldable state after heating the thermoplastic polymer material to a sufficiently elevated temperature, including any such material known in the art. In some embodiments, the thermoplastic polymer comprises ethylene and/or vinyl acetate. In some embodiments, the thermoplastic polymer is or comprises ethylene-vinyl acetate (EVA). The thermoplastic polymer material can be heated to a sufficiently elevated temperature by any means. For instance, in some embodiments, the thermoplastic polymer material can be placed into boiling water, or into near-boiling water that was recently boiled but has been removed from the heating source (e.g., has been removed from the heating source for up to 1, 2, 3, 4, 5, 6, 7, 8, 9, 10, 11, 12, 13, 14, or 15 minutes), for a duration of time sufficient for the thermoplastic polymer material to reach a sufficiently elevated temperature such that it becomes moldable, such as at least 15 seconds, at least 30 seconds, at least 45 seconds, at least 60 seconds, at least 75 seconds, at least 90 seconds, at least 2 minutes, at least 2.5 minutes, at least 3 minutes, at least 4 minutes, or at least 5 minutes. The sufficiently elevated temperature can depend on the particular thermoplastic polymer material used, and can be any temperature sufficiently to render the thermoplastic polymer material moldable. In some embodiments, the sufficiently elevated temperature is at least or at least about 50 degrees C., is at least or at least about 55 degrees C., is at least or at least about 60 degrees C., is at least or at least about 65 degrees C., is at least or at least about 70 degrees C., is at least or at least about 75 degrees C., is at least or at least about 80 degrees C., is at least or at least about 85, or is at least or at least about 90 degrees C. In some embodiments, the sufficiently elevated temperature is between or is between about 75 degrees C. and 90 degrees C. In some embodiments, the sufficiently elevated temperature is between or is between about 80 degrees C. and 85 degrees C.

In some embodiments, the upper sole includes a material that has been molded to substantially conform to the cleat pattern of the cleated shoe. In some embodiments, the upper sole includes a silicone rubber material that has been molded to substantially conform to the cleat pattern of the cleated shoe. In some embodiments, the upper sole includes a thermoplastic polymer material that has been molded to substantially conform to the cleat pattern of the cleated shoe. In some embodiments, the molding of the upper sole is performed by the manufacturer or distributor of the shoe cover. In some embodiments, the molding of the upper sole is performed by the consumer of the shoe cover. In some embodiments, the molding of the upper sole is permanent. In some embodiments, the molding of the upper sole is permanent unless the upper sole is exposed to conditions, e.g., a sufficiently elevated temperature, that cause the upper sole to change into a moldable state. In some embodiments, the molding of the upper sole is temporary.

In some embodiments, the upper sole includes a cavity that aligns with a cleat protruding from a cleated shoe when the cleated shoe is properly inserted into the shoe cover. The cavity of the upper sole forms a cavity pattern in the upper sole. The cavity can be formed by any process for molding material. In some embodiments, the cavity is formed by a process of contacting the cleat of the shoe with the material of the upper sole. In some embodiments, the cavity is formed by a process of contacting the cleat of the shoe with the material of the upper sole while the material is in a liquid or gel state. In some embodiments, the cavity is formed by a process of contacting the cleat of the shoe with the material of the upper sole while the material is in a moldable state, e.g., when a thermoplastic polymer material is heated to a sufficiently elevated temperature. In some embodiments, each cavity of the cavity aligns with no more than one cleat of the shoe. In some embodiments, the cavity pattern aligns with no more than one cleat pattern. In some embodiments, the cavity that aligns with one cleat protruding from the shoe securely holds the cleat tightly to the upper sole after the shoe is properly inserted into the shoe cover and the first cover and the second cover are connected by the first fastener and the second fastener. In some embodiments, each cavity aligns with at least two cleats of the shoe. In some embodiments, the cavity pattern aligns with at least two different cleat patterns. By aligning a cavity pattern with a cleat pattern, this promotes a tighter and more secure fit between the cleated shoe and the sole of the shoe cover, which reduces the risk that the user would trip or fall while running or engaging in sporting activities.

In some embodiments, the volume of a cavity and the volume of a cleat that aligns with the cavity are substantially the same volume. In some embodiments, the volume of a cleat is at least 50%, at least 60%, at least 70%, at least 75%, at least 80%, at least 85%, at least 90%, at least 91%, at least 92%, at least 93%, at least 94%, at least 95%, at least 96%, at least 97%, at least 98%, at least 99%, or is 100% of the volume of a cavity that aligns with the cleat when the cleated shoe is properly inserted into the shoe cover. In some embodiments, at least 75%, at least 80%, at least 85%, at least 90%, at least 91%, at least 92%, at least 93%, at least 94%, at least 95%, at least 96%, at least 97%, at least 98%, at least 99%, or 100% of the volume of a cavity is filled by a cleat when the cleated shoe is properly inserted into the shoe cover. In some embodiments, the volume of each cavity and the volume of a cleat that aligns with each cavity are substantially the same volume. In some embodiments, the volume of each cleat is at least 50%, at least 60%, at least 70%, at least 75%, at least 80%, at least 85%, at least 90%, at least 91%, at least 92%, at least 93%, at least 94%, at least 95%, at least 96%, at least 97%, at least 98%, at least 99%, or is 100% of the volume of each cavity that aligns with each cleat when the cleated shoe is properly inserted into the shoe cover. In some embodiments, at least 75%, at least 80%, at least 85%, at least 90%, at least 91%, at least 92%, at least 93%, at least 94%, at least 95%, at least 96%, at least 97%, at least 98%, at least 99%, or 100% of the volume of each cavity is filled by a cleat when the cleated shoe is properly inserted into the shoe cover. By having the volume of a cavity substantially the same as the volume of a cleat that aligns with the cavity, or by having a high percentage of the volume of a cavity filled by a cleat, this promotes a tighter and more secure fit between the cleated shoe and the shoe cover. This significantly reduces, or even eliminates, the risk that the cleated shoe would slide backward, forward, or sideways relative to the sole while the user is running or engaging in sporting activities, which could cause the user to sustain an injury due to tripping or falling. This also significantly reduces, or even eliminates, the magnitude by which the cleated shoe would slide backward, forward, or sideways relative to the sole while the user is running or engaging in sporting activities, which would reduce the likelihood that the user would trip or fall during use.

In some embodiments, the process of contacting the cleat of the shoe with the elastomeric material of the upper sole is performed while the elastomeric material is in an uncured state. The term "uncured state" as used herein refers to a state in which the elastomeric material is in a gel or liquid state and has not been fully cured into a solid state. As such, an elastomeric material is in an uncured state when it is in a gel or liquid state prior to the initiation of a curing process, during the curing process, or at any other time point prior to the completion of the curing process, so long as the elastomeric material has not achieved a solid state. By contacting the cleat of the shoe with the elastomeric material while the elastomeric material is in an uncured state, the elastomeric material is able to form a cavity that matches the size and shape of the cleat that is contacted with the elastomeric material. In some embodiments, the cleat of the shoe is pressed against the elastomeric material while the elastomeric material is in an uncured state. In some embodiments, the elastomeric material that is in an uncured state is a silicone rubber material. In some embodiments, the upper sole includes a silicone rubber material that includes a cavity formed by a process of curing the silicone rubber material from a gel or liquid state into a solid state.

In some embodiments, the process of contacting the cleat of the shoe with the thermoplastic polymer material of the upper sole is performed while the thermoplastic polymer material is in a moldable state. The term "moldable state" as used herein refers to a state in which the thermoplastic polymer material is capable of being molded, such as after being heated to a sufficiently elevated temperature. As such, a thermoplastic polymer material is in a moldable state when, for instance, it has been heated to a sufficiently elevated temperature to allow the material to be molded, but has not yet cooled such that the material is no longer moldable. By contacting the cleat of the shoe with the thermoplastic polymer material while the thermoplastic polymer material is in a moldable state, the thermoplastic polymer material is able to form a cavity that matches the size and shape of the cleat that is contacted with the thermoplastic polymer material. In some embodiments, the cleat of the shoe is pressed against the thermoplastic polymer material while the thermoplastic polymer material is in a moldable state. In some embodiments, the upper sole includes a thermoplastic polymer material that includes a cavity formed by a process of molding the thermoplastic polymer material.

In some embodiments, the upper sole includes a silicone rubber material that includes a cavity formed by a process of injection molding. In some embodiments, the curing of the silicone rubber material is performed by a manufacturer or distributor of the shoe cover. In some embodiments, the curing of the silicone rubber material is performed by the consumer of the shoe cover. Any system for curing the silicone rubber material can be utilized, such as a platinum-based curing system, a condensation cure system (also known as a tin-cure silicone), a peroxide cure system, or an oxime cure system.

In some embodiments, the upper sole includes a thermoplastic polymer material that includes a cavity formed by a process of injection molding. In some embodiments, the injection molding of the thermoplastic polymer is performed by a manufacturer or distributor of the shoe cover.

Figure 3:
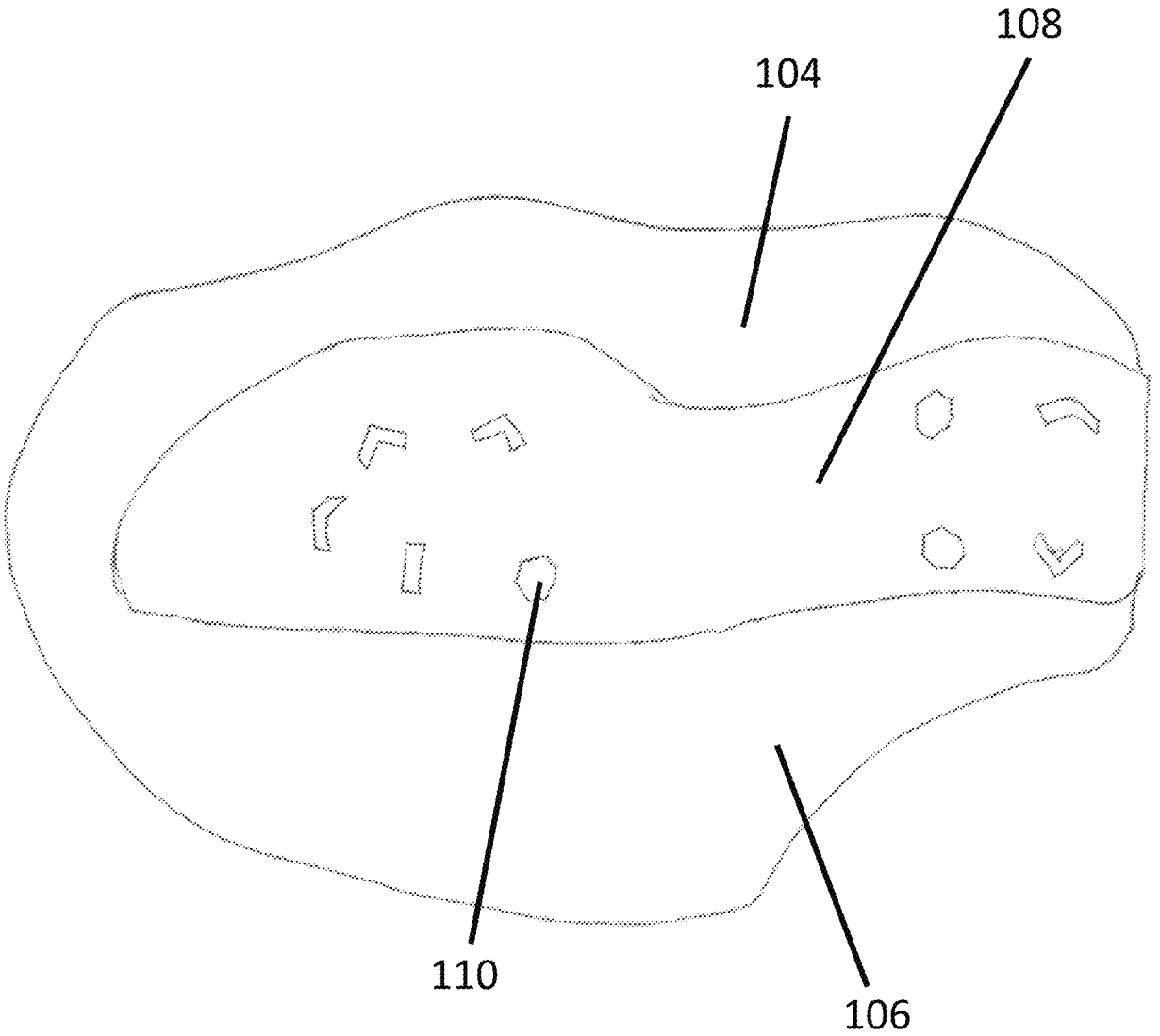
FIG. 3 depicts an embodiment of the shoe cover with a representation of a first cover 104, a second cover 106, and the upper sole 108 comprising a cavity 110.

Returning to FIG. 1A and FIG. 1B, shoe cover 100 includes a first cover 104 and a second cover 106. As shown in more detail in FIG. 3, the first cover 104 and the second cover 106 are connected to the sole 102 and extend upward around the perimeter of the sole 102. In some embodiments, part of the first cover and part of the second cover are connected at the toe region of the shoe cover 100 and at the heel region of the shoe cover 100. This allows, in some embodiments, for the toe region and the heel region of the cleated shoe to be partially secured by the first cover 104 and the second cover 106. The first fastener 112 and the second fastener 114 may then be used to further secure the cleated shoe to the shoe cover 100 once the cleated shoe is properly inserted into the shoe cover 100.

In some embodiments, the first cover is connected to the sole. In some embodiments where the sole comprises an upper sole and a lower sole, the first cover and/or the second cover are connected to the upper sole and/or the lower sole. In some embodiments where the sole comprises an upper sole and a lower sole, the first cover is connected to the upper sole. In some embodiments where the sole comprises an upper sole and a lower sole, the first cover is connected to the lower sole. In some embodiments where the sole comprises an upper sole and a lower sole, the first cover is connected to the upper sole and the lower sole. In some embodiments, the first cover includes a toe region and a heel region. In some embodiments where the sole comprises an upper sole and a lower sole, the first cover is connected to the upper sole or the lower sole and includes a toe region and a heel region.

In some embodiments, the first cover extends from the toe region of the sole to the heel region of the sole. In some embodiments where the sole comprises an upper sole and a lower sole, the first cover extends from the toe region of the upper sole to the heel region of the upper sole. In some embodiments where the sole comprises an upper sole and a lower sole, the first cover extends from the toe region of the lower sole to the heel region of the lower sole.

The shoe cover of the present disclosure also includes a second cover. In some embodiments, the second cover is connected to the sole. In some embodiments where the sole comprises an upper sole and a lower sole, the second cover is connected to the upper sole. In some embodiments where the sole comprises an upper sole and a lower sole, the second cover is connected to the lower sole. In some embodiments where the sole comprises an upper sole and a lower sole, the second cover is connected to the upper sole and the lower sole. In some embodiments, the second cover includes a toe region and a heel region. In some embodiments where the sole comprises an upper sole and a lower sole, the second cover is connected to the upper sole or the lower sole and includes a toe region and a heel region.

In some embodiments, the second cover extends from the toe region of the sole to the heel region of the sole. In some embodiments where the sole comprises an upper sole and a lower sole, the second cover extends from the toe region of the upper sole to the heel region of the upper sole. In some embodiments where the sole comprises an upper sole and a lower sole, the second cover extends from the toe region of the lower sole to the heel region of the lower sole.

The shoe cover can be configured to cover at least part of the outer surface of the shoe when the first cover and the second cover are connected by the first fastener and/or the second fastener. In some embodiments, the shoe cover covers at least 50%, at least 55%, at least 60%, at least 65%, at least 70%, at least 75%, at least 80%, at least 85%, at least 90%, at least 91%, at least 92%, at least 93%, at least 94%, at least 95%, at least 96%, at least 97%, at least 98%, at least 99%, or 100% of the outer surface area of the shoe when the first fastener attaches the heel region of the first cover and the heel region of the second cover, and the second fastener attaches the toe region of the first cover and the toe region of the second cover. In some embodiments, the shoe cover covers at least 75% of the outer surface area of the shoe when the first cover and the second cover are connected by the first fastener and the second fastener. In some embodiments, the shoe cover covers at least 85% of the outer surface area of the shoe when the first cover and the second cover are connected by the first fastener and the second fastener. In some embodiments, the shoe cover covers at least 90% of the outer surface area of the shoe when the first cover and the second cover are connected by the first fastener and the second fastener. In some embodiments, the shoe cover covers at least 95% of the outer surface area of the shoe when the first cover and the second cover are connected by the first fastener and the second fastener. In some embodiments, the shoe cover covers at least 96% of the outer surface area of the shoe when the first cover and the second cover are connected by the first fastener and the second fastener. In some embodiments, the shoe cover covers at least 97% of the outer surface area of the shoe when the first cover and the second cover are connected by the first fastener and the second fastener. In some embodiments, the shoe cover covers at least 98% of the outer surface area of the shoe when the first cover and the second cover are connected by the first fastener and the second fastener. In some embodiments, the shoe cover covers at least 99% of the outer surface area of the shoe when the first cover and the second cover are connected by the first fastener and the second fastener. In some embodiments, the shoe cover covers 100% of the outer surface area of the shoe when the first cover and the second cover are connected by the first fastener and the second fastener. The "outer surface area of the shoe" includes the outward facing portions of the shoe that are visible when the wearer is wearing the shoe, including the bottom of the shoe, and does not include the surface area inside of the shoe where the wearer's foot is placed.

The first cover can include any material useful for protecting, covering, and/or securing a shoe. The second cover can include any material useful for protecting, covering, and/or securing a shoe. In some embodiments, the first cover and/or the second cover include a material selected from the group consisting of elastic material, elastomeric material, elasticized fabric, and mesh material. In some embodiments, the first cover and/or the second cover include a material selected from the group consisting of neoprene, silicone, natural rubber, synthetic rubber, woven cloth, non-woven cloth, natural leather, synthetic leather, plastic, nylon, vinyl, and polyester. In some embodiments, the first cover and/or the second cover is comprised of waterproof material. In some embodiments, "waterproof" refers to the ability of a material to repel water and penetration with respect to water, but does not necessarily refer to a capacity for complete water impenetrability. In some embodiments, the first cover and/or the second cover includes mesh material. In some embodiments, the mesh material is primarily comprised of polyester. In some embodiments, the mesh material is primarily comprised of nylon.

Figure 4A:
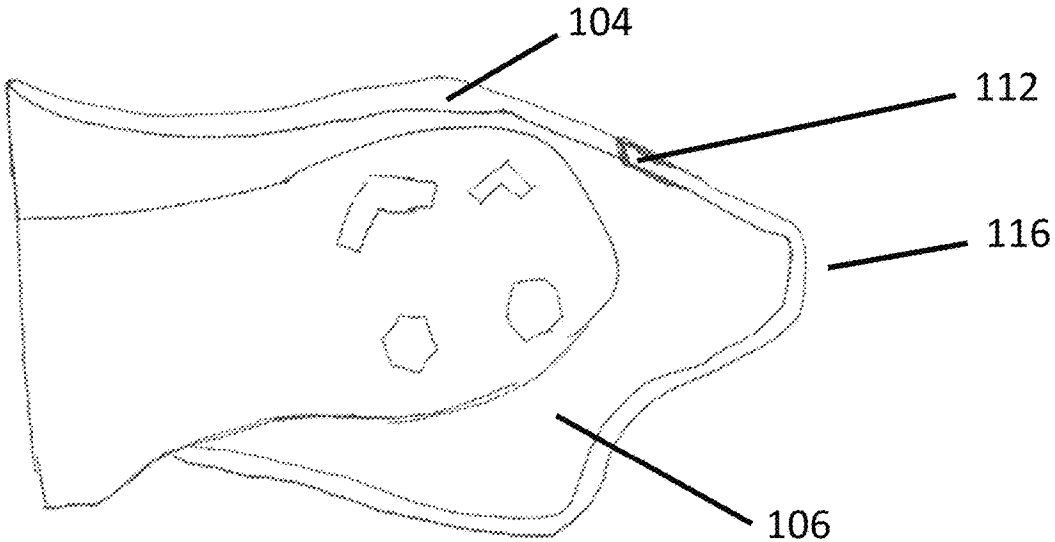
FIG. 4A and FIG. 4B depict embodiments of the first fastener 112 and the second fastener 114, respectively.
Figure 4B:
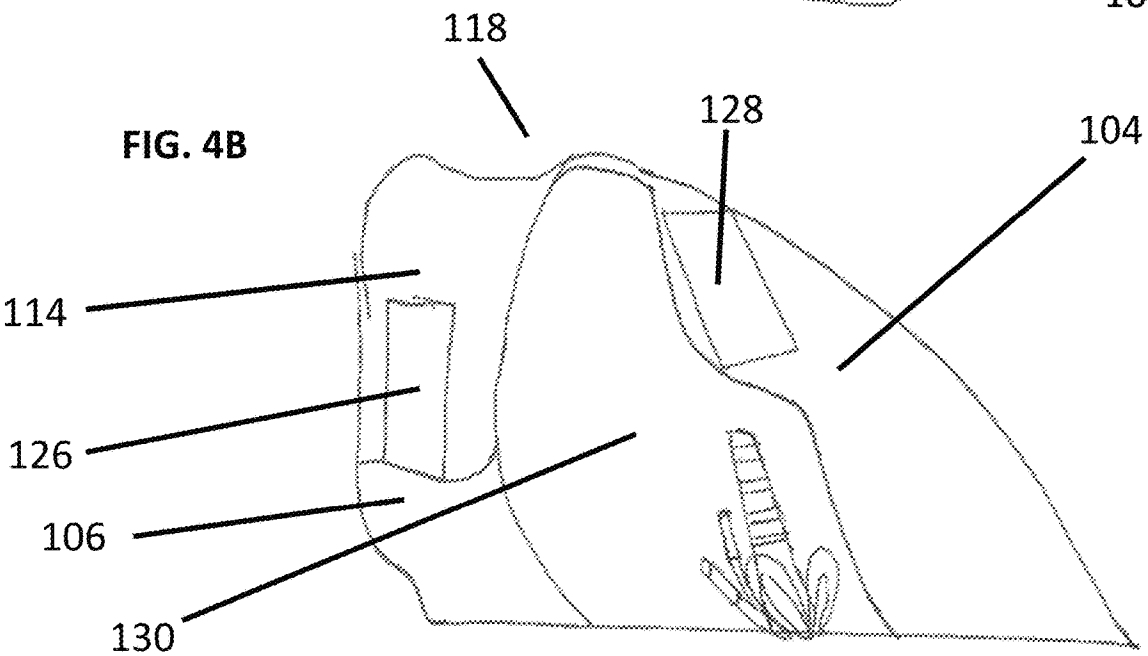

Returning to FIG. 1A and FIG. 1B, shoe cover 100 includes a first fastener 112 and a second fastener 114. The first fastener and the second fastener each reversibly connect part of the first cover and the second cover. As shown in more detail in FIG. 4A, the first fastener 112 secures the cleated shoe to the shoe cover 100 at the heel end 116 by reversibly connecting the first cover 104 and the second cover 106 at the heel end 116 of the shoe cover 100. As shown in FIG. 4B, the second fastener 114 secures the cleated shoe to the shoe cover 100 at the toe end 118 by reversibly connecting the first cover 104 and the second cover 106 at the toe end 118 of the shoe cover 100. FIG. 4B also depicts an engagement region 126 comprising a loop-compatible hook material on the second fastener 114 and an attachment region 128 comprising a hook-compatible loop material on the first cover 104, which provides for a reversible connection between the second fastener 114, which is connected to the second cover 106, and the first cover 104.

In some embodiments, the first fastener and the second fastener provide a tight and secure fit between the cleated shoe and the shoe cover by including a hook-compatible loop material on one of the covers and a loop-compatible hook material on the other cover for each of the first fastener and the second fastener. By using a hook-and-loop material to facilitate the reversible attachment, a secure fit can be obtained when cleated shoes of different sizes and/or shapes are used with the shoe cover. The first fastener provides a secure fit between the cleated shoe and the shoe cover at the heel end of the shoe cover by ensuring that the heel end of the cleated shoe and the heel end of the shoe cover are secured tightly together. The second fastener provides a secure fit between the cleated shoe and the shoe cover at the toe end of the shoe cover by ensuring that the toe end of the cleated shoe and the toe end of the shoe cover are secured tightly together. The second fastener, in some embodiments, also provides a secure fit by holding the cleated shoe securely against the sole due to the positioning of the second fastener over the cuneiform and/or navicular bone of the foot. The combination of the first fastener and the second fastener is advantageous because cleated shoes come in different shapes and sizes and even shoes of the same "size," for example size "8," often differ in their exact dimensions, such as length, width, and height at various locations on the shoe, including the toe and heel. Even a small difference in shoe size may create a loose fit at the toe and/or heel of a shoe cover, which can cause the cleated shoe to slide backward or forward relative to the sole during active use. This reduces performance and increases the risk of injury to the wearer if the wearer were to attempt to run or engage in sporting activities. On the other hand, by incorporating a first fastener at the heel end of the shoe cover and a second fastener at the toe end of the shoe cover, performance is increased and the risk of injury is reduced because the cleated shoe is more securely held in place with a tighter fit at the toe end and the heel end while the wearer is active.

In some embodiments, the first fastener reversibly connects the heel region of the first cover and the heel region of the second cover. In some embodiments, the first cover reversibly connects to the second cover. In some embodiments, the second cover reversibly connects to the first cover. In some embodiments, the first cover reversibly connects to the second cover, and the second cover reversibly connects to the first cover. In some embodiments, the first fastener reversibly connects the first cover and the second cover at the heel end of the shoe cover. The first fastener provides for a secure fit between the shoe cover and the cleated shoe at the heel region of the first cover and the heel region of the second cover. In some embodiments, the first fastener can be adjusted to securely fit cleated shoes of different sizes and/or shapes.

The first fastener can reversibly connect the first cover and the second cover using any attachment mechanism. In some embodiments, the first fastener includes a strap. In some embodiments, the first fastener includes one strap. In some embodiments, the first fastener includes two straps. In some embodiments, the first fastener includes three straps. In some embodiments, the first fastener includes at least four straps. In some embodiments, the strap of the first fastener includes an engagement region.

In some embodiments, the first fastener includes an engagement region. In some embodiments, the second fastener includes an engagement region, and the first cover and/or second cover includes an attachment region. In some embodiments, the first fastener includes an engagement region and an attachment region. In some embodiments, an engagement region of the first fastener is fixed to the first cover. In some embodiments, an engagement region of the first fastener is fixed to the second cover. In some embodiments, an engagement region of the first fastener is fixed to the first cover and an engagement region of the first fastener is fixed to the second cover. In some embodiments, an engagement region of the first fastener is fixed to a strap.

In some embodiments, the second fastener connects the first cover and the second cover. In some embodiments, the first cover connects to the second cover. In some embodiments, the second cover connects to the first cover. In some embodiments, the first cover connects to the second cover, and the second cover connects to the first cover. In some embodiments, the second fastener connects the first cover and the second cover at the toe end of the shoe cover. The second fastener provides for a secure fit between the shoe cover and the cleated shoe at the toe region of the first cover and the toe region of the second cover. In some embodiments, the second fastener can be adjusted to securely fit cleated shoes of different sizes and/or shapes.

The second fastener can connect the first cover and the second cover using any attachment mechanism. In some embodiments, the second fastener includes a strap. In some embodiments, the second fastener includes one strap. In some embodiments, the second fastener includes two straps. In some embodiments, the second fastener includes three straps. In some embodiments, the second fastener includes at least four straps. In some embodiments, the strap of the second fastener includes an engagement region.

In some embodiments, the second fastener includes an engagement region. In some embodiments, the second fastener includes an engagement region, and the first cover and/or second cover includes an attachment region. In some embodiments, the second fastener includes an engagement region and an attachment region. In some embodiments, an engagement region of the second fastener is fixed to the first cover. In some embodiments, an engagement region of the second fastener is fixed to the second cover. In some embodiments, an engagement region of the second fastener is fixed to the first cover and an engagement region of the second fastener is fixed to the second cover. In some embodiments, an engagement region of the second fastener is fixed to a strap.

In some embodiments, the first fastener and/or second fastener includes an engagement region located on the first cover that connects to an attachment region on the second cover. In some embodiments, the first fastener and/or second fastener includes an engagement region located on the second cover that connects to an attachment region on the first cover. In some embodiments, the first fastener and/or second fastener includes an engagement region located on the second cover that connects to an attachment region on the first cover, and an engagement region located on the first cover that connects to an attachment region on the second cover. Each of the engagement regions of the first cover can include any suitable mechanism for reversibly connecting to an attachment region of the second cover, and/or each of the engagement regions of the second cover can include any suitable mechanism for reversibly connecting to an attachment region of the first cover. In some embodiments, the engagement region of the first cover and/or second cover includes a material selected from the group consisting of a loop-compatible hook material, a hook-compatible loop material, a buckle, a stud-compatible socket, and a socket-compatible stud. In some embodiments, the engagement region of the first cover and/or second cover includes a loop-compatible hook material. In some embodiments, the engagement region of the first cover and/or second cover includes a hook-compatible loop material.

In some embodiments, the first cover includes an engagement region comprising a loop-compatible hook material, and the second cover includes an attachment region comprising a hook-compatible loop material, wherein the loop-compatible hook material of the first cover is configured to connect to the hook-compatible loop material of the second cover. In some embodiments, the first cover includes an engagement region comprising a hook-compatible loop material, and the second cover includes an attachment region comprising a loop-compatible hook material, wherein the hook-compatible loop material of the first cover is configured to connect to the loop-compatible hook material of the second cover. In some embodiments, the second cover includes an engagement region comprising a loop-compatible hook material, and the first cover includes an attachment region comprising a hook-compatible loop material, wherein the loop-compatible hook material of the second cover is configured to connect to the hook-compatible loop material of the first cover. In some embodiments, the second cover includes an engagement region comprising a hook-compatible loop material, and the first cover includes an attachment region comprising a loop-compatible hook material, wherein the hook-compatible loop material of the second cover is configured to connect to the loop-compatible hook material of the first cover.

In some embodiments, the first cover includes an attachment region for the first fastener. In some embodiments, the first cover includes an attachment region for the second fastener. In some embodiments, the second cover includes an attachment region for the first fastener. In some embodiments, the second cover includes an attachment region for the second fastener. In some embodiments, the first cover includes an attachment region for each of the one, two, three, or four or more straps of the first fastener. In some embodiments, the first cover includes an attachment region for each of the one, two, three, or four or more straps of the second fastener. In some embodiments, the second cover includes an attachment region for each of the one, two, three, or four or more straps of the first fastener. In some embodiments, the second cover includes an attachment region for each of the one, two, three, or four or more straps of the second fastener. In some embodiments, there is one attachment region for each strap. In some embodiments, there is more than one strap for each attachment region.

In some embodiments, the first cover comprises one, two, three, or four or more attachment regions. In some embodiments, the first cover comprises one, two, three, or four or more engagement regions. In some embodiments, the second cover comprises one, two, three, or four or more attachment regions. In some embodiments, the second cover comprises one, two, three, or four or more engagement regions. In some embodiments, the first cover includes an attachment region for each of the one, two, three, or four or more engagement regions of the second cover. In some embodiments, the second cover includes an attachment region for each of the one, two, three, or four or more engagement regions of the first cover.

Each attachment region can include any material or article suitable for attachment to the engagement region of the first fastener and/or the second fastener. In some embodiments, each attachment region is selected from the group consisting of a hook-compatible loop material, a loop-compatible hook material, a buckle, a stud-compatible socket, and a socket-compatible stud. In some embodiments, an attachment region includes a hook-compatible loop material. In some embodiments, an attachment region includes a loop-compatible hook material. In some embodiments, an attachment region includes a buckle. In some embodiments, an attachment region includes a stud-compatible socket, such as for use with a snap fastening mechanism. In some embodiments, an attachment region includes a socket-compatible stud, such as for use with a snap fastening mechanism.

In some embodiments, the engagement region of the first fastener can connect the first cover and the second cover at any point at the heel end of the shoe cover. In some embodiments, the engagement region of the second fastener can connect the first cover and the second cover at any point at the heel end of the shoe cover. In some embodiments, the engagement region for the first fastener can connect the first cover and the second cover at any point at the heel end of the shoe cover. In some embodiments, the engagement region for the second fastener can connect the first cover and the second cover at any point at the heel end of the shoe cover.

The strap of the first fastener can be any type of strap that utilizes any type of fastening mechanism. The strap of the second fastener can be any type of strap that utilizes any type of fastening mechanism. In some embodiments, the strap of the first fastener and/or the second fastener include one type of fastening mechanism. In some embodiments, the strap of the first fastener and/or the second fastener include two types of fastening mechanisms. In some embodiments, the strap of the first fastener and/or the second fastener include three or more types of fastening mechanisms. In some embodiments, the type of fastening mechanism is selected from the group consisting of a hook and loop fastening mechanism, a snap fastening mechanism, and a buckle fastening mechanism. In some embodiments, the snap fastening mechanism includes the attachment between a stud-compatible socket and a socket-compatible stud. In some embodiments, a strap of the first fastener includes a hook and loop fastening mechanism. In some embodiments, a strap of the second fastener includes a hook and loop fastening mechanism. The hook and loop fastening mechanism includes the attachment between a hook-compatible loop material and a loop-compatible hook material. In some embodiments, a strap of the first fastener and/or the second fastener includes both a hook-compatible loop material and a loop-compatible hook material. In some embodiments, a strap of the first fastener and/or the second fastener includes a hook-compatible loop material. In some embodiments, a strap of the first fastener and/or the second fastener includes a loop-compatible hook material. In some embodiments, a strap of the first fastener and/or the second fastener includes an engagement region that includes a loop-compatible hook material or a hook-compatible loop material, or both.

In some embodiments, a strap of the first fastener is fixed to the first cover. In some embodiments, a strap of the first fastener is fixed to the second cover. In some embodiments, a strap of the first fastener is fixed to the first cover and a strap of the first fastener is fixed to the second cover. In some embodiments, a strap of the second fastener is fixed to the first cover. In some embodiments, a strap of the second fastener is fixed to the second cover. In some embodiments, a strap of the second fastener is fixed to the first cover and a strap of the second fastener is fixed to the second cover.

In some embodiments, a strap of the first fastener can connect the first cover and the second cover at any point at the heel end of the shoe cover. In some embodiments, a strap of the first fastener can connect the first cover and the second cover at any point at the heel end of the shoe cover. In some embodiments, the first fastener connects the first cover and the second cover above the subcutaneous calcaneal bursa (also called the Achilles bursa), which is located between the skin and the site where the bottom of the Achilles tendon connects to the heel bone. By connecting the first cover and the second cover above the subcutaneous calcaneal bursa, the risk of developing retrocalcaneal burstitis is reduced because there is less pressure against the subcutaneous calcaneal bursa. Burstitis is inflammation of a bursa, a thin-walled sac lined with synovial tissue. The function of the bursa is to facilitate the movement of tendons over bone surfaces. Burstitis may be caused by, e.g., excessive frictional forces, trauma, systemic diseases, or infection. Retrocalcaneal burstitis involves the subcutaneous calcaneal bursa. Treatment of burstitis generally consists of prevention of the aggravating condition and rest of the involved body part. Retrocalcaneal burstitis can be caused by excessive frictional forces caused by the heel of a shoe or a shoe cover. Thus, in some embodiments, the first cover and the second cover are connected above the subcutaneous calcaneal bursa, such that excessive frictional force against the bursa is avoided.

In some embodiments, a strap of the second fastener can connect the first cover and the second cover at any point at the toe end of the shoe cover. In some embodiments, a strap of the second fastener can connect the first cover and the second cover at any point at the toe end of the shoe cover. In some embodiments, the second fastener connects the first cover and the second cover over the laces of the shoe. In some embodiments, the second fastener connects the first cover and the second cover over a cuneiform and/or navicular bone of the foot. In some embodiments, the second fastener connects the first cover and the second cover such that the laces of the shoe are secured and protected under the first cover and/or the second cover. In some embodiments, the second fastener connects the first cover and the second cover over a metatarsal bone of the foot.

The shoe cover of the present disclosure can be a shoe cover configured for use with a left shoe or a right shoe. As such, each embodiment of the shoe cover provided herein can be configured for use with a left shoe or a right shoe. It is also contemplated that reference to a particular embodiment of a shoe cover provided herein includes such an embodiment configured for use with a left shoe and an embodiment configured for use with a right shoe. For example, each embodiment of the shoe cover provided herein can be included in a kit comprising a pair of such shoe covers, wherein the pair of shoe covers comprises a shoe cover configured to cover a left shoe and a shoe cover configured to cover a right shoe.

The shoe cover of the present disclosure can be used, in some embodiments, with a cleated shoe. The cleated shoe can be any article of footwear that includes a cleat incorporated into, or otherwise protruding from, the underside of the cleated shoe's sole to provide, for example, traction. In some embodiments, a "cleat" is a structure on a shoe that engages with a ground surface and may further penetrate some kinds of ground surfaces, such as grass or dirt. In some embodiments, a "cleat" includes cleats, spikes, studs, and the like. For example, a soccer shoe may have cleats on the underside of the shoe's sole to provide traction on a soccer field. In some embodiments, a "cleat" also refers to a structure on cycling shoes that engages with the pedal and may provide traction for the cycling shoe against the pedal. The cleat can be made of any material useful for providing traction to a cleated shoe, such as metal, plastic, or rubber. In some embodiments, a "cleat" refers to a cleat of at least a certain length, such as at least 1/16", at least 1/8", at least 1/6", at least 1/5", at least 1/4", at least 1/3", or at least 1/2" in length.

In some embodiments, the cleated shoe is an athletic shoe. The athletic shoe can be any shoe that provides traction for the wearer during participation in an athletic event or activity. In some embodiments, the cleated shoe is an athletic shoe selected from the group consisting of soccer shoes, football shoes, track & field shoes, baseball shoes, softball shoes, rugby shoes, cycling shoes, lacrosse shoes, and golf shoes. In some embodiments, the cleated shoe is a boot. In some embodiments, a cleated shoe is formed by adding a cleat to a non-cleated shoe.

Also provided herein is a method for covering a cleated shoe using the shoe cover of any of the embodiments described herein, the method comprising: a) inserting a cleated shoe into the shoe cover; b) connecting the first cover and the second cover using the first fastener; and c) connecting the first cover and the second cover using the second fastener. The first fastener can be any first fastener described herein and the second fastener can be any second fastener described herein. The connection between the first cover and the second cover using the first fastener can be any connection or attachment mechanism described herein. In some embodiments, the first fastener connects the first cover and the second cover using one or more attachment mechanisms selected from the group consisting of a hook and loop fastening mechanism, a snap fastening mechanism, and a buckle fastening mechanism. The connection between the first cover and the second cover using the second fastener can be any connection or attachment mechanism described herein. In some embodiments, the second fastener connects the first cover and the second cover using one or more attachment mechanisms selected from the group consisting of a hook and loop fastening mechanism, a snap fastening mechanism, and a buckle fastening mechanism. The cleated shoe can be any cleated shoe as described herein. In some embodiments, the cleated shoe is an athletic shoe selected from the group consisting of soccer shoes, football shoes, track & field shoes, baseball shoes, softball shoes, rugby shoes, cycling shoes, lacrosse shoes, and golf shoes. In some embodiments, the cleated shoe is a boot. In some embodiments, the cleated shoe comprises a cleat and the shoe cover comprises a cavity, and each cavity aligns with no more than one cleat of the shoe when the cleated shoe is inserted into the shoe cover. This helps to ensure that the shoe cover and the cleated shoe maintain a tight fit at the sole region of the shoe such that the consumer is able to run or engage in sporting activities while wearing the shoe cover.

Also provided herein is a method for forming a cleat pattern in the shoe cover of any of the embodiments herein. In some embodiments, the cleat pattern is formed in the sole of the cleat cover. In some embodiments, the cleat pattern is formed in the upper sole of the shoe cover. In some embodiments, the cleat pattern is formed in the elastomeric material of the upper sole of the shoe cover. In some embodiments, the cleat pattern is formed in the sole insert of the sole insert casing. In some embodiments, the cleat pattern is formed in the elastomeric material of the sole insert of the sole insert casing.

In some embodiments, provided herein is a method for forming a cleat pattern in the shoe cover of any of the embodiments herein, the method comprising: a) obtaining a cleated shoe having a cleat pattern formed by one or more cleats; b) adding an elastomeric material in an uncured state to the sole; c) contacting the one or more cleats of the cleated shoe with the elastomeric material while the elastomeric material is in an uncured state; d) curing the elastomeric material. The cleated shoe can be any cleated shoe described herein. The elastomeric material in an uncured state can be any elastomeric material capable of being in an uncured state, such as a silicone rubber material. The elastomeric material can be added to any part of the sole, such as the upper sole and/or the lower sole. In some embodiments, the elastomeric material is added on the top of the lower sole inside of the shoe cover and forms the upper sole, or part of the upper sole. In some embodiments, the elastomeric material is added to the upper sole inside of the shoe cover and forms part of the upper sole. After adding the elastomeric material in an uncured state to the sole, the one or more cleats of the cleated shoe is contacted with the elastomeric material while the elastomeric material is in an uncured state, such as by properly inserting the cleated shoe into the shoe cover. This allows for the cleat pattern of the cleated shoe to be molded into the sole of the shoe cover. In particular, each cleat of the cleated shoe forms a cavity in the elastomeric material. Depending on the particular curing process that is employed, the curing process may begin before, simultaneously with, or after the one or more cleats of the cleated shoe is contacted with the elastomeric material. In some embodiments, the cleated shoe is removed from the shoe cover before the elastomeric material is fully cured. In some embodiments, the cleated shoe is removed from the shoe cover after the elastomeric material is fully cured. In some embodiments, the cleated shoe is removed from the shoe cover while the elastomeric material is being cured. Any system for curing the elastomeric material can be used. In some embodiments in which the elastomeric material is a silicone rubber material, the curing system is a platinum-based curing system, a condensation cure system (also known as a tin-cure silicone), a peroxide cure system, or an oxime cure system.

In some embodiments, provided herein is a method for forming a cleat pattern in the shoe cover of any of the embodiments herein, the method comprising: a) obtaining a cleated shoe having a cleat pattern formed by one or more cleats; b) obtaining a sole insert casing; c) adding an elastomeric material in an uncured state to the sole insert casing; d) contacting the one or more cleats of the cleated shoe with the elastomeric material while the elastomeric material is in an uncured state; e) curing the elastomeric material. The cleated shoe can be any cleated shoe described herein. The sole insert casing can be any sole insert casing described herein that provides a structure to which the elastomeric material can be added. In some embodiments, the sole insert casing comprises a removable base that can be removed during the curing process or after the curing process is complete. The elastomeric material in an uncured state can be any elastomeric material capable of being in an uncured state, such as a silicone rubber material. In some embodiments, the elastomeric material is added to the sole insert casing prior to, simultaneously with, or after the initiation of the curing process. After the elastomeric material in an uncured state has been added to the sole insert casing, the one or more cleats of the cleated shoe is contacted with the elastomeric material while the elastomeric material is in an uncured state. This contacting can, in some embodiments, be performed while the sole insert casing is not attached to the shoe cover or a component thereof. In some embodiments, this contacting can be performed while the sole insert casing is attached to the shoe cover or a component thereof. This allows for the cleat pattern of the cleated shoe to be molded into the sole of the shoe cover. In particular, each cleat of the cleated shoe forms a cavity in the elastomeric material. Depending on the particular curing process that is employed, the curing process may begin before, simultaneously with, or after the one or more cleats of the cleated shoe is contacted with the elastomeric material. In some embodiments, the cleated shoe is removed from the shoe cover before the elastomeric material is fully cured. In some embodiments, the cleated shoe is removed from the shoe cover after the elastomeric material is fully cured. In some embodiments, the cleated shoe is removed from the shoe cover while the elastomeric material is being cured. Any system for curing the elastomeric material can be used. In some embodiments in which the elastomeric material is a silicone rubber material, the curing system is a platinum-based curing system, a condensation cure system (also known as a tin-cure silicone), a peroxide cure system, or an oxime cure system.

In some embodiments, provided herein is a method for forming a cleat pattern in the shoe cover of any of the embodiments herein, the method comprising: a) obtaining a cleated shoe having a cleat pattern formed by one or more cleats; b) obtaining a sole insert comprising an elastomeric material in an uncured state; c) contacting the one or more cleats of the cleated shoe with the elastomeric material while the elastomeric material is in an uncured state; d) curing the elastomeric material. The cleated shoe can be any cleated shoe described herein. The elastomeric material in an uncured state can be any elastomeric material capable of being in an uncured state, such as a silicone rubber material. In some embodiments, the sole insert comprises an elastomeric material in an uncured state by being packaged or otherwise designed such that curing does not begin until the consumer, manufacturer, or distributor takes action to initiate the curing process. In some embodiments, the sole insert is encompassed within a sole insert casing. Once the sole insert is ready to begin the molding process, the one or more cleats of the cleated shoe is contacted with the elastomeric material while the elastomeric material is in an uncured state. This contacting can, in some embodiments, be performed while the sole insert is not attached to the shoe cover or a component thereof. In some embodiments, this contacting can be performed while the sole insert is attached to the shoe cover or a component thereof. This allows for the cleat pattern of the cleated shoe to be molded into the sole of the shoe cover. In particular, each cleat of the cleated shoe forms a cavity in the elastomeric material. Depending on the particular curing process that is employed, the curing process may begin before, simultaneously with, or after the one or more cleats of the cleated shoe is contacted with the elastomeric material. In some embodiments, the cleated shoe is removed from the shoe cover before the elastomeric material is fully cured. In some embodiments, the cleated shoe is removed from the shoe cover after the elastomeric material is fully cured. In some embodiments, the cleated shoe is removed from the shoe cover while the elastomeric material is being cured. Any system for curing the elastomeric material can be used. In some embodiments in which the elastomeric material is a silicone rubber material, the curing system is a platinum-based curing system, a condensation cure system (also known as a tin-cure silicone), a peroxide cure system, or an oxime cure system.

Also provided herein is a method for manufacturing a shoe cover for use with a cleated shoe, the method comprising: a) providing a sole; b) connecting a first cover comprising a toe region and a heel region to the sole; c) connecting a second cover comprising a toe region and a heel region to the sole; d) providing a first fastener that reversibly connects the heel region of the first cover and the heel region of the second cover; and e) providing a second fastener that reversibly connects the toe region of the first cover and the toe region of the second cover.

Also provided herein is a kit. In some embodiments, the kit comprises any shoe cover described herein. In some embodiments, the kit comprises a pair of any shoe cover described herein, wherein the pair of shoe covers comprises an embodiment of the shoe cover configured to cover a left shoe and an embodiment of the shoe cover configured to cover a right shoe. In some embodiments, the kit comprises any sole insert described herein. In some embodiments, the kit comprises a pair of any sole insert described herein, wherein the pair of sole inserts comprises an embodiment of the sole insert configured for use with a shoe cover configured to cover a left shoe and an embodiment of the sole insert configured for use with a shoe cover configured to cover a right shoe. In some embodiments, the kit comprises any sole insert casing described herein. In some embodiments, the kit comprises a pair of any sole insert casing described herein, wherein the pair of sole insert casings comprises an embodiment of the sole insert casing configured for use with a shoe cover configured to cover a left shoe and an embodiment of the sole insert casing configured for use with a shoe cover configured to cover a right shoe. In some embodiments, the kit comprises an elastomeric material in an uncured state. In some embodiments, the kit comprises any shoe cover described herein and an elastomeric material in an uncured state. In some embodiments, the kit comprises a pair of any shoe cover described herein and an elastomeric material in an uncured state, wherein the pair of shoe covers comprises an embodiment of the shoe cover configured to cover a left shoe and an embodiment of the shoe cover configured to cover a right shoe. In some embodiments, the kit comprises any sole insert casing described herein and an elastomeric material in an uncured state. In some embodiments, the kit comprises a pair of any sole insert casing described herein and an elastomeric material in an uncured state, wherein the pair of sole insert casing comprises an embodiment of the sole insert configured for use with a shoe cover configured to cover a left shoe and an embodiment of the sole insert configured for use with a shoe cover configured to cover a right shoe. In some embodiments, the kit comprises any shoe cover described herein, any sole insert casing described herein, and an elastomeric material in an uncured state. In some embodiments, the kit comprises a pair of any shoe cover described herein, a pair of any sole insert casing described herein, and an elastomeric material in an uncured state, wherein the pair of shoe covers comprises an embodiment of the shoe cover configured to cover a left shoe and an embodiment of the shoe cover configured to cover a right shoe, and wherein the pair of sole insert casing comprises an embodiment of the sole insert configured for use with a shoe cover configured to cover a left shoe and an embodiment of the sole insert configured for use with a shoe cover configured to cover a right shoe. In some embodiments, the kit comprises a pair of any shoe cover described herein, and a sole insert comprising a thermoplastic polymer that becomes moldable at a sufficiently elevated temperature, wherein the pair comprises a shoe cover configured to cover a left shoe and a shoe cover configured to cover a right shoe.

In some embodiments, provided herein is a kit comprising a pair of any of the shoe covers described herein, wherein the pair of shoe covers comprises an embodiment of the shoe cover configured to cover a left shoe and an embodiment of the shoe cover configured to cover a right shoe.

In some embodiments, provided herein is a kit comprising a pair of any of the shoe covers described herein, the kit comprising: a) a pair of any of the shoe covers described herein; and b) an elastomeric material in an uncured state, wherein the pair of shoe covers comprises an embodiment of the shoe cover configured to cover a left shoe and an embodiment of the shoe cover configured to cover a right shoe. The elastomeric material can be any elastomeric material, such as a silicone rubber material. In some embodiments, the elastomeric material is provided within a container selected from the group consisting of a tube, vile, syringe, bottle, can, and tub.

In some embodiments, provided herein is a kit comprising a pair of shoe covers, the kit comprising: a) a pair of any of the shoe covers described herein; b) a sole insert comprising an elastomeric material in an uncured state, wherein the pair of shoe covers comprises an embodiment of the shoe cover configured to cover a left shoe and an embodiment of the shoe cover configured to cover a right shoe. In some embodiments, the sole insert is encompassed within a sole insert casing. The elastomeric material can be any elastomeric material, such as a silicone rubber material.

In some embodiments, provided herein is a kit comprising a sole insert casing and an elastomeric material in an uncured state.

In some embodiments, provided herein is a kit comprising an elastomeric material in an uncured state.

In some embodiments, provided herein is a kit comprising a sole insert comprising an elastomeric material that comprises a cavity.

In some embodiments, provided herein is a kit comprising a pair of shoe covers, the kit comprising: a) a pair of any of the shoe covers described herein; and b) a sole insert comprising a thermoplastic polymer that becomes moldable at a sufficiently elevated temperature; wherein the pair comprises a shoe cover configured to cover a left shoe and a shoe cover configured to cover a right shoe.

In some embodiments, provided herein is a kit comprising: a) a sole insert casing; and b) a thermoplastic polymer that becomes moldable at a sufficiently elevated temperature.

In some embodiments, provided herein is a kit comprising a sole insert comprising a thermoplastic polymer that becomes moldable at a sufficiently elevated temperature.

The present disclosure also provides a shoe cover for use with a cleated shoe that includes a sole; a cover connected to the sole and comprising an opening; and a fastener connected to the cover that reversibly narrows the opening. Embodiments of the shoe cover described herein are especially suitable for athletic footwear that have cleats to provide, for example, traction. Some embodiments include a sole that is molded with a cavity to align with the cleat pattern of the cleated shoe for a safe and secure fit. The fastener provides for a secure fit of the shoe cover to the cleated shoe at the upper region over a metatarsal bone, a cuneiform bone, and/or a navicular bone of the wearer, and provides for a secure fit of the shoe cover to the cleated shoe at or along the opening. Some embodiments allow the wearer to run or engage in sporting activities by providing for a safe and secure fit through a molded sole, a cover, and a fastener connected to the cover that reversibly narrows the opening. The shoe covers described herein include shoe covers configured to be shoe covers for a cleated shoe intended to be worn on the left foot, and shoe covers configured to be shoe covers for a cleated shoe intended to be worn on the right foot.

Figure 6A:
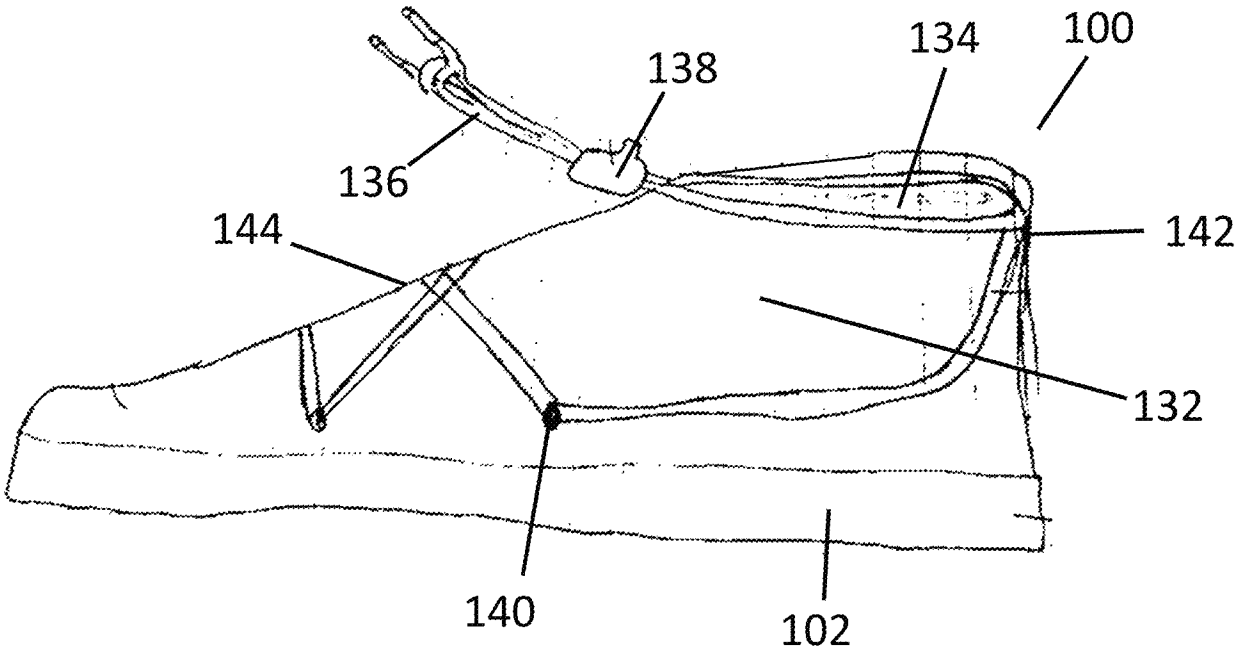
FIG. 6A and FIG. 6B depict an embodiment of the shoe cover 100 with exemplary components identified, including a fastener that includes a string 136 and a cord lock 138, and an anchor 140 associated with the cover.
Figure 6B:
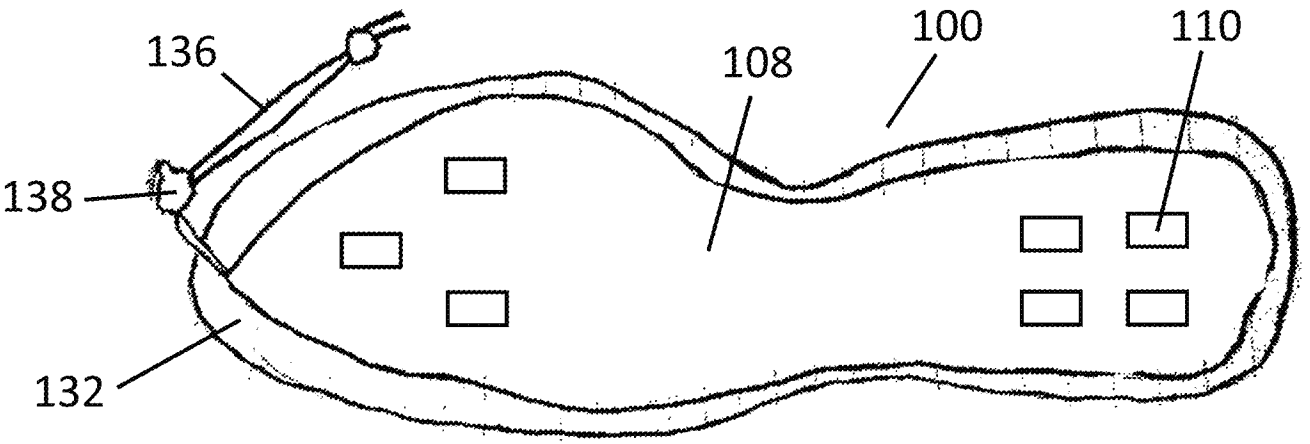

Turning to the drawings, FIGS. 6A and 6B depict an embodiment of the shoe cover when the fastener is tightened (FIG. 6A) and when the fastener is loosened (FIG. 6B). As shown in FIG. 6A, this embodiment includes a sole 102, a cover 132 that is connected to the sole 102 that includes an opening 134, and a fastener that is connected to the cover and reversibly narrows the opening 134. The fastener in this embodiment includes a string 136 and a cord lock 138. Also shown in this embodiment is an anchor 140 associated with the cover 132 through which the string 136 passes through. FIG. 6A depicts this embodiment in a configuration where the fastener is tightened. The tightening in this embodiment occurs by pulling, or otherwise causing, the string 136 to pass through the cord lock 138 such that the length of the string that is connected to, or otherwise associated with, the cover is reduced. The tightening in this embodiment also provides for an increase in tension between the upper region 144 of the cover and the cleated shoe, an increase in tension between the rear side 142 of the cover and the cleated shoe, and narrows the opening 134 of the cover. FIG. 6B depicts this embodiment in a configuration where the fastener is loosened. The loosening in this embodiment occurs by pulling, or otherwise causing, the string 136 to pass through the cord lock 138 such that the length of the string that is connected to, or otherwise associated with, the cover is increased, thereby allowing for the opening to widen in size, e.g., diameter and/or perimeter. By loosening the fastener, the opening can be widened such that it becomes easier and/or quicker for the user to insert the cleated shoe into the shoe cover and align a cleat of the cleated shoe with a cavity 110.

Figure 7A:
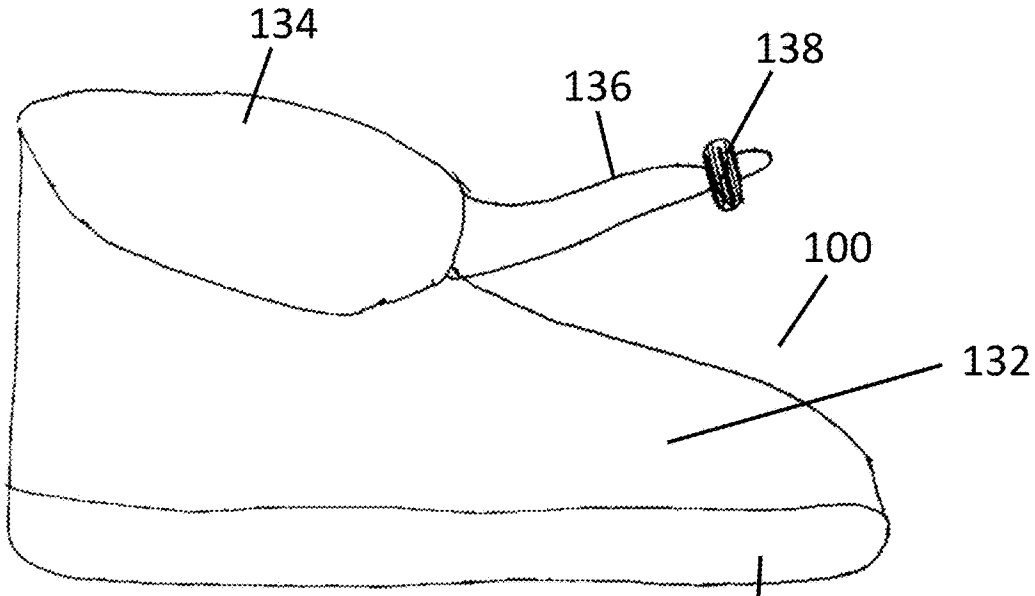
FIG. 7A and FIG. 7B depict another embodiment of the shoe cover 100 with exemplary components identified, including a fastener that includes a string 136 and a cord lock 138.
Figure 7B:
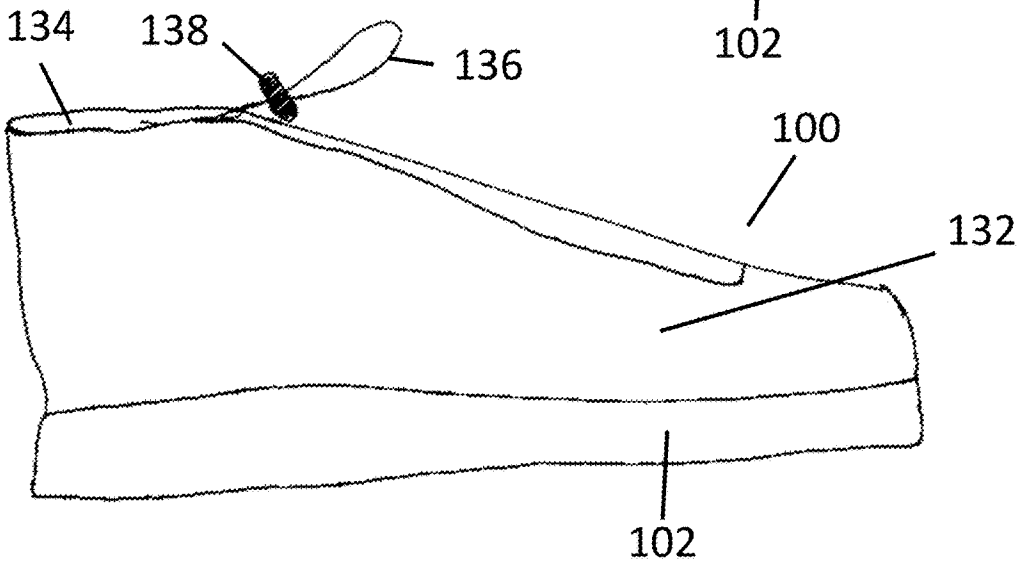

FIGS. 7A and 7B depict another embodiment of the shoe cover in which the string 136 passes through a casing embedded within the cover such that the string 136 is not visible from the outside of the shoe cover when passing across the upper region. FIG. 7A depicts this embodiment in a configuration where the fastener is loosened, and FIG. 7B depicts this embodiment in a configuration where the fastener is tightened. The fastener in this embodiment includes a string 136 and a cord lock 138.

The shoe cover comprises a toe end and a heel end. In some embodiments, the sole is positioned between the toe end and the heel end of the shoe cover and the cover extends from the toe end of the shoe cover to the heel end of the shoe cover.

In some embodiments, the cover is connected to the sole and comprises an opening. The cover, in some embodiments, provides protection against the elements (e.g., dirt, mud, water, dust, etc.) and also helps provide a tight and secure fit between the shoe cover and the cleated shoe. The opening is a region of the shoe cover where the wearer inserts the cleated shoe into the shoe cover. Typically, the wearer will insert the cleated shoe into the shoe cover when the fastener is loosened, such that the opening is sufficiently wide to allow the cleated shoe to be inserted into the shoe cover with greater ease than if the fastener was not loosened or was tightened. In some embodiments, the cover comprises an upper region, a left side, a right side, and a rear end. The upper region is a region of the cover that covers (e.g., passes over) the upper portion of the wearer's foot above the metatarsal bones, cuneiform bones, and navicular bones, and is situated between the left side and the right side of the cover. In some embodiments, the upper region is a region of the shoe cover that covers the tongue, or a portion of the tongue, of the cleated shoe, when the cleated shoe is properly inserted into the shoe cover. The left side and the right side of the cover are regions on opposite sides of the upper region. In some embodiments, the cover comprises an opening region that surrounds the perimeter of the opening. In some embodiments, the opening region comprises the rear end. The rear end is the region of the cover on the heel end of the shoe cover that is situated near the opening region.

In some embodiments, the cover is connected to the sole. In some embodiments where the sole comprises an upper sole and a lower sole, the cover is connected to the upper sole and/or the lower sole. In some embodiments where the sole comprises an upper sole and a lower sole, the cover is connected to the upper sole. In some embodiments where the sole comprises an upper sole and a lower sole, the cover is connected to the lower sole. In some embodiments where the sole comprises an upper sole and a lower sole, the cover is connected to the upper sole and the lower sole. In some embodiments, the cover includes a toe region and a heel region. In some embodiments where the sole comprises an upper sole and a lower sole, the cover is connected to the upper sole or the lower sole and includes a toe region and a heel region.

In some embodiments, the sole is any sole as described herein, including any sole as described above that comprises an upper sole and a lower sole. In some embodiments comprising an upper sole and a lower sole, the upper sole is any upper sole as described above and the lower sole is any lower sole as described above. In some embodiments, the shoe cover further comprises a sole insert. The sole insert can be any sole insert described above. In some embodiments, the shoe cover further comprises a sole insert casing. The sole insert casing can be any sole insert casing described above. In some embodiments, the sole, upper sole, lower sole, sole insert, and/or sole insert casing of the shoe cover can be any embodiments described above in accordance with any of the teachings above.

The shoe cover can be configured to cover at least part of the outer surface of the shoe when the fastener is tightened. In some embodiments, the shoe cover covers at least 50%, at least 55%, at least 60%, at least 65%, at least 70%, at least 75%, at least 80%, at least 85%, at least 90%, at least 91%, at least 92%, at least 93%, at least 94%, at least 95%, at least 96%, at least 97%, at least 98%, at least 99%, or 100% of the outer surface area of the shoe when the fastener is tightened. In some embodiments, the shoe cover covers at least 75% of the outer surface area of the shoe when the fastener is tightened. In some embodiments, the shoe cover covers at least 85% of the outer surface area of the shoe when the fastener is tightened. In some embodiments, the shoe cover covers at least 90% of the outer surface area of the shoe when the fastener is tightened. In some embodiments, the shoe cover covers at least 95% of the outer surface area of the shoe when the fastener is tightened. In some embodiments, the shoe cover covers at least 96% of the outer surface area of the shoe when the fastener is tightened. In some embodiments, the shoe cover covers at least 97% of the outer surface area of the shoe when the fastener is tightened. In some embodiments, the shoe cover covers at least 98% of the outer surface area of the shoe when the fastener is tightened. In some embodiments, the shoe cover covers at least 99% of the outer surface area of the shoe when the first fastener is tightened. In some embodiments, the shoe cover covers 100% of the outer surface area of the shoe when the fastener is tightened. The "outer surface area of the shoe" includes the outward facing portions of the shoe that are visible when the wearer is wearing the shoe, including the bottom of the shoe, and does not include the surface area inside of the shoe where the wearer's foot is placed.

The cover can include any material useful for protecting, covering, and/or securing a shoe. In some embodiments, the cover includes a material selected from the group consisting of elastic material, elastomeric material, elasticized fabric, and mesh material. In some embodiments, the cover includes a material selected from the group consisting of neoprene, silicone, natural rubber, synthetic rubber, woven cloth, non-woven cloth, natural leather, synthetic leather, plastic, nylon, vinyl, and polyester. In some embodiments, the cover is comprised of waterproof material. In some embodiments, "waterproof" refers to the ability of a material to repel water and penetration with respect to water, but does not necessarily refer to a capacity for complete water impenetrability. In some embodiments, the cover includes mesh material. In some embodiments, the mesh material is primarily comprised of polyester. In some embodiments, the mesh material is primarily comprised of nylon.

In some embodiments, the fastener is connected to the cover and reversibly narrows the opening. The fastener can reversibly narrow the opening by any means. In some embodiments, the fastener reversibly narrows the opening when tightened. In some embodiments, the tightening of the fastener occurs by pulling, or otherwise causing, a string to pass through a cord lock such that the length of the string that is connected to, or otherwise associated with, the cover is reduced. In some embodiments, the fastener reversibly widens the opening when loosened. In some embodiments, the loosening of the fastener occurs by pulling, or otherwise causing, a string to pass through a cord lock such that the length of the string that is connected to, or otherwise associated with, the cover is increased.

In some embodiments, the fastener comprises a string. In some embodiments, the string is an elastic string. In some embodiments, the fastener comprises more than one string, such as two strings, e.g., two elastic strings. As used herein, reference to "the string" or "the elastic string" also includes reference to embodiments where more than one string, e.g., two strings, are used. For instance, in some embodiments, a single elastic string is connected to the cover and passes through two holes in a cord lock (i.e., each end of the elastic string passes through its own hole in the cord lock), while, in other embodiments, two elastic strings are connected to the cover and each of the elastic strings pass through its own hole in a cord lock (e.g., one end of each elastic string is connected to the cover or is connected to the other elastic string, and the other end of each elastic string passes through its own hole in a cord lock). In some embodiments, the fastener comprises a strap. In some embodiments, the fastener comprises a buckle.

In some embodiments, the fastener comprises a drawstring. In some embodiments, the drawstring can comprise a string or cord made of any material suitable for use in accordance with the teachings herein. In some embodiments, the drawstring comprises a string comprising one or more materials selected from the group consisting of cotton, polyester, and nylon. In some embodiments, the drawstring comprises an elastic string. In some embodiments, the fastener comprises a string and a cord lock. In some embodiments, the fastener is a drawstring fastener and comprises a string and a cord lock. In some embodiments, the fastener comprises an elastic string and a cord lock. In some embodiments, the drawstring comprises a string and a cord lock. In some embodiments, the drawstring comprises an elastic string and a cord lock.

The string can, in some embodiments, be any string suitable for use as described herein. In some embodiments, the string as described herein is an elastic string. The elastic string can be any elastic string or cord that includes any elastic material. In some embodiments, the string, e.g., the elastic string, includes a covering that provides resistance to ultraviolet (UV) sunlight, abrasion, water, fire, or mildew, or combinations thereof. In some embodiments, the string, e.g., the elastic string, includes a nylon covering. In some embodiments, the string is or is about 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 8.25 mm, 8.5 mm, 8.75 mm, 9 mm, 9.25 mm, 9.5 mm, 9.75 mm, or 1 cm in diameter. In some embodiments, the string is or is about 1/16 inch, 1/8 inch, 3/16 inch, 1/4 inch, 5/16 inch, 3/8 inch, 7/16 inch, or 1/2 inch in diameter.

The cord lock can be any cord lock. In some embodiments, the cord lock includes a barrel, a toggle, and a spring. When the cord lock is squeezed, the hole portion in the toggle aligns with the hole portion in the barrel, thereby releasing tension between the cord lock and the string so that the cord lock can be moved more freely and easily along the string. When the cord lock is released, tension between the cord lock and the string is created and/or increased at the location on the string, where tension is engaged, which prevents the cord lock from moving along the string. In some embodiments, the cord lock is a single cord lock that includes one hole for a string to pass through. In some embodiments, the cord lock is a double cord lock that includes two holes for a string(s) to pass through. In some embodiments, the cord lock includes a hole that has a diameter that is or is about 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 8.25 mm, 8.5 mm, 8.75 mm, 9 mm, 9.25 mm, 9.5 mm, 9.75 mm, or 1 cm. In some embodiments, the cord lock includes a hole that has a diameter that is or is about 1/16 inch, 1/8 inch, 3/16 inch, 1/4 inch, 5/16 inch, 3/8 inch, 7/16 inch, or 1/2 inch. In some embodiments, the drawstring comprises a string that has a diameter that is or is about the same size as the diameter of the hole or holes in the cord lock. In some embodiments, the fastener comprises a cord lock that has a hole or holes with a diameter that is or is about 0.25 mm, 0.5 mm, 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, or 5 mm less than the diameter of the string.

In some embodiments, the string is connected to the cover such that the string, when tightened using the fastener, provides for a tighter or more secure fit between the upper region of the shoe cover and the cleated shoe. In some embodiments, the string is connected to the cover such that the string, when tightened using the fastener, provides for a tighter or more secure fit between (a) the cleated shoe and/or the wearer's ankle and (b) the opening region. In some embodiments, the string is connected to the cover such that the string, when tightened using the fastener, provides for a tighter or more secure fit between the upper region of the shoe cover and the cleated shoe, and provides for a tighter or more secure fit between (a) the cleated shoe and/or the wearer's ankle and (b) the opening region.

In some embodiments, the string crosses over the upper region of the cover from the left side to the right side and/or from the right side to the left side. In some embodiments, the string crosses over the upper region of the cover from the left side to the right side and/or from the right side to the left side at least two times. In some embodiments, the string crosses over the upper region of the cover from the left side to the right side and/or from the right side to the left side at least three times. In some embodiments, the string crosses over the upper region of the cover from the left side to the right side and/or from the right side to the left side at least four times. In some embodiments, the string crosses over the upper region of the cover from the left side to the right side and/or from the right side to the left side, and passes along the opening (e.g., along the opening region). In some embodiments, the cover comprises an opening region that surrounds the opening, and the string passes along the opening region. The opening region that surrounds the opening can be characterized by having a perimeter that surrounds the opening. In some embodiments, the opening region comprises a perimeter around the opening and the string passes along at least 20%, at least 30%, at least 40%, at least 50%, at least 60%, at least 70%, at least 80%, at least 90%, or at least 95% of the perimeter. In some embodiments, the string passes along the opening region by any means, such as through one or more anchors in the cover, or by passing through one or more casings in the cover.

In some embodiments, the string passes through one or more anchors in the cover. In some embodiments, the string passes through at least one anchor in the left side of the cover and at least one anchor in the right side of the cover. In some embodiments, the string passes through at least one anchor in the upper region of the cover. In some embodiments, the string passes through at least one anchor in the left side of the cover, at least one anchor in the right side of the cover, and at least one anchor in the upper region of the cover. In some embodiments, the string passes through two anchors in the left side of the cover and two anchors in the right side of the cover. As used herein, an "anchor" refers to a fixed location in the cover where the string passes through, which may be formed by, e.g., a hole in the cover or a ring or other enclosed structure fixed to the cover that allows the elastic string to pass through it. In some embodiments, the anchor is a hole in the cover and is reinforced with a grommet.

In some embodiments, the string passes through an anchor in the left side of the cover and an anchor in the right side of the cover, such that the string passes over the upper region of the cover from the left side of the cover to the right side of the cover or from the right side of the cover to the left side of the cover. In some embodiments, the string passes through an anchor in the left side of the cover and an anchor in the right side of the cover, such that the string passes over a metatarsal bone, a cuneiform bone, and/or a navicular bone of the wearer. In some embodiments, the string passes one, two, or three times over one or more of a metatarsal bone, a cuneiform bone, and/or a navicular bone, or a combination thereof, of the wearer.

In some embodiments, the string passes through two anchors in the left side of the cover and two anchors in the right side of the cover, such that the string passes at least two times over the upper region of the cover. It is to be understood that reference to the string passing "over the upper region of the cover" is not to be construed to mean that the string passes only on top of the upper region of the cover, e.g., the exterior of the upper region facing upward, but, rather, this also includes embodiments where the string passes through the upper region of the cover, or passes below the upper region of the cover, e.g., the interior of the upper region facing inside the shoe cover. Accordingly, the phrase "over the upper region of the cover" can, in some embodiments, be construed to mean "across the upper region of the cover" in any manner, such as across the outside, inside, or underside of the cover. In some embodiments, the string passes through two anchors in the left side of the cover and two anchors in the right side of the cover, such that the string passes at least two times over one or more of a metatarsal bone, a cuneiform bone, and/or a navicular bone, or a combination thereof, of the wearer. In some embodiments, the string passes two, three, four, five, or six or more times over one or more of a metatarsal bone, a cuneiform bone, and/or a navicular bone, or a combination thereof, of the wearer.

In some embodiments, the string passes through two anchors in the left side of the cover and two anchors in the right side of the cover, such that the string passes at least three times over the upper region of the cover. In some embodiments, the string passes through two anchors in the left side of the cover and two anchors in the right side of the cover, such that the string passes at least three times over one or more of a metatarsal bone, a cuneiform bone, and/or a navicular bone, or a combination thereof, of the wearer. In some embodiments, the string passes three, four, five, or six or more times over one or more of a metatarsal bone, a cuneiform bone, and/or a navicular bone, or a combination thereof, of the wearer.

In some embodiments, the string passes through an anchor in the left side of the cover, followed by an anchor in the right side of the cover, followed by an anchor in the left side of the cover, followed by an anchor in the right side, such that the string passes at least two times over the upper region of the cover. In some embodiments, the string passes through an anchor in the left side of the cover, followed by an anchor in the right side of the cover, followed by an anchor in the left side of the cover, followed by an anchor in the right side, such that the string passes at least two times over one or more of a metatarsal bone, a cuneiform bone, and/or a navicular bone, or a combination thereof, of the wearer. In some embodiments, the string passes two, three, four, five, or six or more times over one or more of a metatarsal bone, a cuneiform bone, and/or a navicular bone, or a combination thereof, of the wearer.

In some of any of the embodiments described herein, the string, when passing between an anchor in the left side of the cover and an anchor in the right side of the cover, passes over at least one, at least two, at least three, at least four, or five metatarsal bones of the wearer. In some of any of the embodiments described herein, the string, when passing between an anchor in the left side of the cover and an anchor in the right side of the cover, passes over at least two metatarsal bones of the wearer. In some of any of the embodiments described herein, the string, when passing between an anchor in the left side of the cover and an anchor in the right side of the cover, passes over at least three metatarsal bones of the wearer. In some of any of the embodiments described herein, the string, when passing between an anchor in the left side of the cover and an anchor in the right side of the cover, passes over at least four metatarsal bones of the wearer. In some embodiments, at least one (e.g., at least one, two, three, four, five, or six or more) of the one, two, three, four, five, or six or more passes between an anchor in the left side of the cover and an anchor in the right side of the cover, passes over at least one, at least two, at least three, at least four, or five metatarsal bones of the wearer. In some embodiments, at least one (e.g., at least one, two, three, four, five, or six or more) of the one, two, three, four, five, or six or more passes between an anchor in the left side of the cover and an anchor in the right side of the cover, passes over at least two, at least three, or at least four metatarsal bones of the wearer.

In some of any of the embodiments described herein, the string, when passing between an anchor in the left side of the cover and an anchor in the right side of the cover, passes over at least one, at least two, or three cuneiform bones of the wearer. In some of any of the embodiments described herein, the string, when passing between an anchor in the left side of the cover and an anchor in the right side of the cover, passes over at least one cuneiform bone of the wearer. In some of any of the embodiments described herein, the string, when passing between an anchor in the left side of the cover and an anchor in the right side of the cover, passes over at least two cuneiform bones of the wearer. In some of any of the embodiments described herein, the string, when passing between an anchor in the left side of the cover and an anchor in the right side of the cover, passes over three cuneiform bones of the wearer. In some embodiments, at least one (e.g., at least one, two, three, four, five, or six or more) of the one, two, three, four, five, or six or more passes between an anchor in the left side of the cover and an anchor in the right side of the cover, passes over at least one, at least two, or three cuneiform bones of the wearer. In some embodiments, at least one (e.g., at least one, two, three, four, five, or six or more) of the one, two, three, four, five, or six or more passes between an anchor in the left side of the cover and an anchor in the right side of the cover, passes over at least two cuneiform bones of the wearer.

In some embodiments, the cover comprises a casing that passes between the left side of the cover and the right side of the cover through the upper region at least one time (e.g., one, two, three, four, five, or six or more times), and the string passes through the casing; and the cover comprises a casing along the perimeter of the opening region that the string passes through. In some embodiments, the casing that passes between the left side of the cover and the right side of the cover through the upper region at least one time is continuous with (i.e., connected to) the casing along the perimeter of the opening region. In some embodiments, the casing that passes between the left side of the cover and the right side of the cover through the upper region at least one time is distinct from (i.e., separate from) the casing along the perimeter of the opening region.

In some embodiments, the string passes through an anchor in the left side of the cover, an anchor in the right side of the cover, and an anchor in the opening region of the cover, such that the string passes at least one time (e.g., one, two, three, four, five, or six or more times) over the upper region of the cover between the left side of the cover and the right side of the cover and passes along at least a portion of the opening region.

In some embodiments, the string passes between the left side and the right side of the cover across the upper region of the cover at least one time (e.g., one, two, three, four, five, or six or more times) and passes along at least a portion of the opening region of the cover (e.g., at least 20%, at least 30%, at least 40%, at least 50%, at least 60%, at least 70%, at least 80%, at least 90%, or at least 95% of the perimeter of the opening region of the cover). The string can pass along at least a portion of the opening region of the cover using any connection and/or guiding means such that, in some embodiments, tightening the fastener results in a narrowing of the diameter and/or a reduction in the surface area of the opening. In some embodiments, the string passes through at least one anchor in the opening region. In some embodiments, the opening region comprises a casing along the perimeter of the opening region that the string passes through.

In some embodiments, the string is connected to one or more points along the perimeter of the opening of the cover, such as in the opening region. In some embodiments, the string passes along at least a portion of the opening region of the cover. In some embodiments, the string passes through a casing in the opening region such that it passes along at least a portion of the opening region. In some embodiments, the string passes along at least 20%, at least 30%, at least 40%, at least 50%, at least 60%, at least 70%, at least 80%, at least 90%, or at least 95% of the perimeter of the opening region of the cover. In some embodiments, the string passes along at least a portion of the opening region such that, when the fastener is tightened, the area of the opening can be decreased by at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, or at least 95% compared to the area of the opening when the fastener is partially or fully loosened. The area of the opening can be calculated, e.g., using standard mathematical equations for determining surface area. If the opening is a circle, as it may be in some embodiments, the area of the opening can be calculated, e.g., by the following formula: $Area=\pi r^2$.

In some embodiments, the shoe cover covers at least 50%, at least 55%, at least 60%, at least 65%, at least 70%, at least 75%, at least 80%, at least 85%, at least 90%, at least 91%, at least 92%, at least 93%, at least 94%, at least 95%, at least 96%, at least 97%, at least 98%, at least 99%, or 100% of the outer surface area of the cleated shoe when the cleated shoe is properly inserted into the shoe cover and the fastener is tightened.

In some embodiments, when the cleated shoe is properly inserted into the shoe cover and the fastener is tightened, the fastener increases tension between the cover and the cleated shoe. The increase in tension between the cover and the cleated shoe can occur at various locations on the cover, depending on the locations on the cover where the string passes through. In some embodiments, when the cleated shoe is properly inserted into the shoe cover and the fastener is tightened, the fastener increases tension between the upper region of the cover and the cleated shoe, increases tension between the rear side of the cover and the cleated shoe, and narrows the opening of the cover. In some embodiments, when the cleated shoe is properly inserted into the shoe cover and the fastener is tightened, the fastener increases tension between the upper region of the cover and the cleated shoe. In some embodiments, when the cleated shoe is properly inserted into the shoe cover and the fastener is tightened, the fastener increases tension between the rear side of the cover and the cleated shoe. In some embodiments, when the cleated shoe is properly inserted into the shoe cover and the fastener is tightened, the fastener narrows the opening of the cover. In some embodiments, when the cleated shoe is properly inserted into the shoe cover and the fastener is tightened, the fastener increases tension between the upper region of the cover and the cleated shoe, and increases tension between the rear side of the cover and the cleated shoe. The narrowing of the opening can be demonstrated by a decrease in the surface area of the opening. In some embodiments, when the fastener narrows the opening of the cover by tightening, the area of the opening is decreased by at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, or at least 95% compared to the area of the opening when the fastener is partially or fully loosened.

The shoe cover of the present disclosure can be a shoe cover configured for use with a left shoe or a right shoe. As such, each embodiment of the shoe cover provided herein can be configured for use with a left shoe or a right shoe. It is also contemplated that reference to a particular embodiment of a shoe cover provided herein includes such an embodiment configured for use with a left shoe and an embodiment configured for use with a right shoe. For example, each embodiment of the shoe cover provided herein can be included in a kit comprising a pair of such shoe covers, wherein the pair of shoe covers comprises a shoe cover configured to cover a left shoe and a shoe cover configured to cover a right shoe.

The shoe cover of the present disclosure can be used, in some embodiments, with a cleated shoe. The cleated shoe can be any article of footwear that includes a cleat incorporated into, or otherwise protruding from, the underside of the cleated shoe's sole to provide, for example, traction. In some embodiments, a "cleat" is a structure on a shoe that engages with a ground surface and may further penetrate some kinds of ground surfaces, such as grass or dirt. In some embodiments, a "cleat" includes cleats, spikes, studs, and the like. For example, a soccer shoe may have cleats on the underside of the shoe's sole to provide traction on a soccer field. In some embodiments, a "cleat" also refers to a structure on cycling shoes that engages with the pedal and may provide traction for the cycling shoe against the pedal. The cleat can be made of any material useful for providing traction to a cleated shoe, such as metal, plastic, or rubber. In some embodiments, a "cleat" refers to a cleat of at least a certain length, such as at least 1/16", at least 1/8", at least 1/6", at least 1/5", at least 1/4", at least 1/3", or at least 1/2" in length.

In some embodiments, the cleated shoe is an athletic shoe. The athletic shoe can be any shoe that provides traction for the wearer during participation in an athletic event or activity. In some embodiments, the cleated shoe is an athletic shoe selected from the group consisting of soccer shoes, football shoes, track & field shoes, baseball shoes, softball shoes, rugby shoes, cycling shoes, lacrosse shoes, and golf shoes. In some embodiments, the cleated shoe is a boot. In some embodiments, a cleated shoe is formed by adding a cleat to a non-cleated shoe.

Also provided herein is a method for covering a cleated shoe using the shoe cover of any of the embodiments described herein, the method comprising: a) inserting a cleated shoe into the shoe cover; and b) tightening the fastener. The fastener can be any fastener described herein. In some embodiments, the fastener is a drawstring fastener. In some embodiments, the fastener is a drawstring fastener comprising a string (e.g., an elastic string) and a cord lock. The cleated shoe can be any cleated shoe as described herein. In some embodiments, the cleated shoe is an athletic shoe selected from the group consisting of soccer shoes, football shoes, track & field shoes, baseball shoes, softball shoes, rugby shoes, cycling shoes, lacrosse shoes, and golf shoes. In some embodiments, the cleated shoe is a boot. In some embodiments, the cleated shoe comprises a cleat and the shoe cover comprises a cavity, and each cavity aligns with no more than one cleat of the shoe when the cleated shoe is inserted into the shoe cover. This helps to ensure that the shoe cover and the cleated shoe maintain a tight fit at the sole region of the shoe such that the consumer is able to run or engage in sporting activities while wearing the shoe cover.

Also provided herein is a method for forming a cleat pattern in the shoe cover of any of the embodiments herein. In some embodiments, the cleat pattern is formed in the sole of the cleat cover. In some embodiments, the cleat pattern is formed in the upper sole of the shoe cover. In some embodiments, the cleat pattern is formed in the elastomeric material of the upper sole of the shoe cover. In some embodiments, the cleat pattern is formed in the sole insert of the sole insert casing. In some embodiments, the cleat pattern is formed in the elastomeric material of the sole insert of the sole insert casing.

In some embodiments, provided herein is a method for forming a cleat pattern in the shoe cover of any of the embodiments herein, the method comprising: a) obtaining a cleated shoe having a cleat pattern formed by one or more cleats; b) adding an elastomeric material in an uncured state to the sole; c) contacting the one or more cleats of the cleated shoe with the elastomeric material while the elastomeric material is in an uncured state; d) curing the elastomeric material. The cleated shoe can be any cleated shoe described herein. The elastomeric material in an uncured state can be any elastomeric material capable of being in an uncured state, such as a silicone rubber material. The elastomeric material can be added to any part of the sole, such as the upper sole and/or the lower sole. In some embodiments, the elastomeric material is added on the top of the lower sole inside of the shoe cover and forms the upper sole, or part of the upper sole. In some embodiments, the elastomeric material is added to the upper sole inside of the shoe cover and forms part of the upper sole. After adding the elastomeric material in an uncured state to the sole, the one or more cleats of the cleated shoe is contacted with the elastomeric material while the elastomeric material is in an uncured state, such as by properly inserting the cleated shoe into the shoe cover. This allows for the cleat pattern of the cleated shoe to be molded into the sole of the shoe cover. In particular, each cleat of the cleated shoe forms a cavity in the elastomeric material. Depending on the particular curing process that is employed, the curing process may begin before, simultaneously with, or after the one or more cleats of the cleated shoe is contacted with the elastomeric material. In some embodiments, the cleated shoe is removed from the shoe cover before the elastomeric material is fully cured. In some embodiments, the cleated shoe is removed from the shoe cover after the elastomeric material is fully cured. In some embodiments, the cleated shoe is removed from the shoe cover while the elastomeric material is being cured. Any system for curing the elastomeric material can be used. In some embodiments in which the elastomeric material is a silicone rubber material, the curing system is a platinum-based curing system, a condensation cure system (also known as a tin-cure silicone), a peroxide cure system, or an oxime cure system.

In some embodiments, provided herein is a method for forming a cleat pattern in the shoe cover of any of the embodiments herein, the method comprising: a) obtaining a cleated shoe having a cleat pattern formed by one or more cleats; b) obtaining a sole insert casing; c) adding an elastomeric material in an uncured state to the sole insert casing; d) contacting the one or more cleats of the cleated shoe with the elastomeric material while the elastomeric material is in an uncured state; e) curing the elastomeric material. The cleated shoe can be any cleated shoe described herein. The sole insert casing can be any sole insert casing described herein that provides a structure to which the elastomeric material can be added. In some embodiments, the sole insert casing comprises a removable base that can be removed during the curing process or after the curing process is complete. The elastomeric material in an uncured state can be any elastomeric material capable of being in an uncured state, such as a silicone rubber material. In some embodiments, the elastomeric material is added to the sole insert casing prior to, simultaneously with, or after the initiation of the curing process. After the elastomeric material in an uncured state has been added to the sole insert casing, the one or more cleats of the cleated shoe is contacted with the elastomeric material while the elastomeric material is in an uncured state. This contacting can, in some embodiments, be performed while the sole insert casing is not attached to the shoe cover or a component thereof. In some embodiments, this contacting can be performed while the sole insert casing is attached to the shoe cover or a component thereof. This allows for the cleat pattern of the cleated shoe to be molded into the sole of the shoe cover. In particular, each cleat of the cleated shoe forms a cavity in the elastomeric material. Depending on the particular curing process that is employed, the curing process may begin before, simultaneously with, or after the one or more cleats of the cleated shoe is contacted with the elastomeric material. In some embodiments, the cleated shoe is removed from the shoe cover before the elastomeric material is fully cured. In some embodiments, the cleated shoe is removed from the shoe cover after the elastomeric material is fully cured. In some embodiments, the cleated shoe is removed from the shoe cover while the elastomeric material is being cured. Any system for curing the elastomeric material can be used. In some embodiments in which the elastomeric material is a silicone rubber material, the curing system is a platinum-based curing system, a condensation cure system (also known as a tin-cure silicone), a peroxide cure system, or an oxime cure system.

In some embodiments, provided herein is a method for forming a cleat pattern in the shoe cover of any of the embodiments herein, the method comprising: a) obtaining a cleated shoe having a cleat pattern formed by one or more cleats; b) obtaining a sole insert comprising an elastomeric material in an uncured state; c) contacting the one or more cleats of the cleated shoe with the elastomeric material while the elastomeric material is in an uncured state; d) curing the elastomeric material. The cleated shoe can be any cleated shoe described herein. The elastomeric material in an uncured state can be any elastomeric material capable of being in an uncured state, such as a silicone rubber material. In some embodiments, the sole insert comprises an elastomeric material in an uncured state by being packaged or otherwise designed such that curing does not begin until the consumer, manufacturer, or distributor takes action to initiate the curing process. In some embodiments, the sole insert is encompassed within a sole insert casing. Once the sole insert is ready to begin the molding process, the one or more cleats of the cleated shoe is contacted with the elastomeric material while the elastomeric material is in an uncured state. This contacting can, in some embodiments, be performed while the sole insert is not attached to the shoe cover or a component thereof. In some embodiments, this contacting can be performed while the sole insert is attached to the shoe cover or a component thereof. This allows for the cleat pattern of the cleated shoe to be molded into the sole of the shoe cover. In particular, each cleat of the cleated shoe forms a cavity in the elastomeric material. Depending on the particular curing process that is employed, the curing process may begin before, simultaneously with, or after the one or more cleats of the cleated shoe is contacted with the elastomeric material. In some embodiments, the cleated shoe is removed from the shoe cover before the elastomeric material is fully cured. In some embodiments, the cleated shoe is removed from the shoe cover after the elastomeric material is fully cured. In some embodiments, the cleated shoe is removed from the shoe cover while the elastomeric material is being cured. Any system for curing the elastomeric material can be used. In some embodiments in which the elastomeric material is a silicone rubber material, the curing system is a platinum-based curing system, a condensation cure system (also known as a tin-cure silicone), a peroxide cure system, or an oxime cure system.

Also provided herein is a method for manufacturing a shoe cover for use with a cleated shoe, the method comprising: a) providing a sole; b) connecting a cover to the sole; and c) providing a fastener that reversibly narrows an opening in the cover.

Also provided herein is a kit. In some embodiments, the kit comprises any shoe cover described herein. In some embodiments, the kit comprises a pair of any shoe cover described herein, wherein the pair of shoe covers comprises an embodiment of the shoe cover configured to cover a left shoe and an embodiment of the shoe cover configured to cover a right shoe. In some embodiments, the kit comprises any sole insert described herein. In some embodiments, the kit comprises a pair of any sole insert described herein, wherein the pair of sole inserts comprises an embodiment of the sole insert configured for use with a shoe cover configured to cover a left shoe and an embodiment of the sole insert configured for use with a shoe cover configured to cover a right shoe. In some embodiments, the kit comprises any sole insert casing described herein. In some embodiments, the kit comprises a pair of any sole insert casing described herein, wherein the pair of sole insert casings comprises an embodiment of the sole insert casing configured for use with a shoe cover configured to cover a left shoe and an embodiment of the sole insert casing configured for use with a shoe cover configured to cover a right shoe. In some embodiments, the kit comprises an elastomeric material in an uncured state. In some embodiments, the kit comprises any shoe cover described herein and an elastomeric material in an uncured state. In some embodiments, the kit comprises a pair of any shoe cover described herein and an elastomeric material in an uncured state, wherein the pair of shoe covers comprises an embodiment of the shoe cover configured to cover a left shoe and an embodiment of the shoe cover configured to cover a right shoe. In some embodiments, the kit comprises any sole insert casing described herein and an elastomeric material in an uncured state. In some embodiments, the kit comprises a pair of any sole insert casing described herein and an elastomeric material in an uncured state, wherein the pair of sole insert casing comprises an embodiment of the sole insert configured for use with a shoe cover configured to cover a left shoe and an embodiment of the sole insert configured for use with a shoe cover configured to cover a right shoe. In some embodiments, the kit comprises any shoe cover described herein, any sole insert casing described herein, and an elastomeric material in an uncured state. In some embodiments, the kit comprises a pair of any shoe cover described herein, a pair of any sole insert casing described herein, and an elastomeric material in an uncured state, wherein the pair of shoe covers comprises an embodiment of the shoe cover configured to cover a left shoe and an embodiment of the shoe cover configured to cover a right shoe, and wherein the pair of sole insert casing comprises an embodiment of the sole insert configured for use with a shoe cover configured to cover a left shoe and an embodiment of the sole insert configured for use with a shoe cover configured to cover a right shoe. In some embodiments, the kit comprises a pair of any shoe cover described herein, and a sole insert comprising a thermoplastic polymer that becomes moldable at a sufficiently elevated temperature, wherein the pair comprises a shoe cover configured to cover a left shoe and a shoe cover configured to cover a right shoe.

In some embodiments, provided herein is a kit comprising a pair of any of the shoe covers described herein, wherein the pair of shoe covers comprises an embodiment of the shoe cover configured to cover a left shoe and an embodiment of the shoe cover configured to cover a right shoe.

In some embodiments, provided herein is a kit comprising a pair of any of the shoe covers described herein, the kit comprising: a) a pair of any of the shoe covers described herein; and b) an elastomeric material in an uncured state, wherein the pair of shoe covers comprises an embodiment of the shoe cover configured to cover a left shoe and an embodiment of the shoe cover configured to cover a right shoe. The elastomeric material can be any elastomeric material, such as a silicone rubber material. In some embodiments, the elastomeric material is provided within a container selected from the group consisting of a tube, vile, syringe, bottle, can, and tub.

In some embodiments, provided herein is a kit comprising a pair of shoe covers, the kit comprising: a) a pair of any of the shoe covers described herein; b) a sole insert comprising an elastomeric material in an uncured state, wherein the pair of shoe covers comprises an embodiment of the shoe cover configured to cover a left shoe and an embodiment of the shoe cover configured to cover a right shoe. In some embodiments, the sole insert is encompassed within a sole insert casing. The elastomeric material can be any elastomeric material, such as a silicone rubber material.

In some embodiments, provided herein is a kit comprising a sole insert casing and an elastomeric material in an uncured state.

In some embodiments, provided herein is a kit comprising an elastomeric material in an uncured state.

In some embodiments, provided herein is a kit comprising a sole insert comprising an elastomeric material that comprises a cavity.

In some embodiments, provided herein is a kit comprising a pair of shoe covers, the kit comprising: a) a pair of any of the shoe covers described herein; and b) a sole insert comprising a thermoplastic polymer that becomes moldable at a sufficiently elevated temperature; wherein the pair comprises a shoe cover configured to cover a left shoe and a shoe cover configured to cover a right shoe.

In some embodiments, provided herein is a kit comprising: a) a sole insert casing; and b) a thermoplastic polymer that becomes moldable at a sufficiently elevated temperature.

In some embodiments, provided herein is a kit comprising a sole insert comprising a thermoplastic polymer that becomes moldable at a sufficiently elevated temperature.

In the above descriptions of embodiments, reference is made to the accompanying drawings, which form a part hereof, and in which specific embodiments that can be practiced are shown by way of example. Although the disclosed embodiments have been fully described with reference to the accompanying drawings, it is to be noted that various changes and modifications will become apparent to those skilled in the art. Such changes and modifications are to be understood as being included within the scope of the disclosed embodiments as defined by the appended claims. It should be understood that the various embodiments have been presented by way of example only, and not by way of limitation. Likewise, the various diagrams may depict an example architectural or other configuration for the embodiments, which is done to aid in understanding the features and functionality that can be included in the disclosed embodiments. The disclosure is not restricted to the illustrated example architectures and configurations, but can be implemented using a variety of alternative architectures and configurations. Additionally, although the invention is described above in terms of various exemplary embodiments and implementations, it should be understood that the various features and functionality described in at least one of the individual embodiments are not limited in their applicability to the particular embodiment with which they are described. They, instead, can be applied alone, or in some combination, to at least one of the other embodiments of the invention, whether or not such embodiments are described, and whether or not such features are presented as being a part of a described embodiment. Thus, the breadth and scope of the invention should not be limited by any of the above-described exemplary embodiments.

Terms and phrases used in this disclosure, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known," and terms of similar meaning, should not be construed as limiting the item described to a given time period, or to an item available as of a given time. Instead, these terms should be read to encompass conventional, traditional, normal, or standard technologies that may be available, known now, or at any time in the future. Likewise, a group of items linked with the conjunction "and" should not be read as requiring that each and every one of those items be present in the grouping, but, rather, should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements, or components of the invention may be described or claimed in the singular, the plural is contemplated to be within the scope thereof unless limitation to the singular is explicitly stated. For example, use of "a" or "an" should be understood to include both singular and plural unless explicitly stated. For instance, "a cleat" is understood to include reference to a single cleat as well as to more than one cleat, when relevant. The presence of broadening words and phrases, such as "one or more," "at least," "but not limited to," or other like phrases in some instances, shall not be read to mean that the narrower case is intended or required in instances where such broadening phrases may be absent.

EXEMPLARY EMBODIMENTS

Among the provided embodiments are:

1. A shoe cover for use with a cleated shoe, comprising:
   a sole;
   a first cover connected to the sole and comprising a toe region and a heel region;
   a second cover connected to the sole and comprising a toe region and a heel region;
   a first fastener that reversibly connects the heel region of the first cover and the heel region of the second cover; and
   a second fastener that reversibly connects the toe region of the first cover and the toe region of the second cover.
2. The shoe cover of embodiment 1, wherein the sole comprises a lower sole and an upper sole.

3. The shoe cover of embodiment 2, wherein the upper sole comprises a material selected from the group consisting of elastomeric material and foam material.
4. The shoe cover of embodiment 1, wherein the shoe cover further comprises a sole insert.
5. The shoe cover of embodiment 4, wherein the sole comprises a lower sole and the sole insert comprises an upper sole.
6. The shoe cover of embodiment 4 or embodiment 5, wherein the sole insert and the shoe cover are reversibly attached.
7. The shoe cover of any one of embodiments 4-6, further comprising a sole insert casing that encompasses the sole insert.
8. The shoe cover of embodiment 7, wherein the sole insert casing comprises a heat-resistant elastomeric material.
9. The shoe cover of embodiment 7 or embodiment 8, wherein the sole insert comprises a perimeter and a bottom and the sole insert casing surrounds the perimeter of the sole insert and covers the bottom of the sole insert.
10. The shoe cover of any one of embodiments 7-9, wherein the sole insert casing and the shoe cover are reversibly attached.
11. The shoe cover of any one of embodiments 4-10, wherein the sole insert comprises a material selected from the group consisting of elastomeric material and foam material.
12. The shoe cover of embodiment 3 or embodiment 11, wherein the elastomeric material is a silicone rubber material.
13. The shoe cover of any one of embodiments 4-10, wherein the sole insert comprises a thermoplastic polymer material.
14. The shoe cover of embodiment 2, wherein the upper sole comprises a thermoplastic polymer material.
15. The shoe cover of embodiment 14, wherein the thermoplastic polymer material becomes moldable when heated to a sufficiently elevated temperature.
16. The shoe cover of any one of embodiments 3, 11, and 12, wherein the elastomeric material comprises a cavity that aligns with a cleat protruding from the cleated shoe when the cleated shoe is properly inserted into the shoe cover.
17. The shoe cover of any one of embodiments 13-15, wherein the thermoplastic polymer material comprises a cavity that aligns with a cleat protruding from the cleated shoe when the cleated shoe is properly inserted into the shoe cover.
18. The shoe cover of embodiment 16, wherein the cavity is formed by a process of contacting the cleat of the cleated shoe with the elastomeric material.
19. The shoe cover of embodiment 18, wherein the process of contacting the cleat of the cleated shoe with the elastomeric material is performed while the elastomeric material is in an uncured state.
20. The shoe cover of any one of embodiments 16, 18, and 19, wherein each cavity aligns with no more than one cleat of the cleated shoe.
21. The shoe cover of embodiment 17, wherein the cavity is formed by a process of contacting the cleat of the cleated shoe with the thermoplastic polymer material.
22. The shoe cover of embodiment 21, wherein the process of contacting the cleat of the cleated shoe with the thermoplastic polymer material is performed while the thermoplastic polymer material is in a moldable state.
23. The shoe cover of any one of embodiments 1-22, wherein the sole is positioned between a toe end and a heel end of the shoe cover, and wherein the first cover extends from the toe end of the shoe cover to the heel end of the shoe cover, and/or the second cover extends from the toe end of the shoe cover to the heel end of the shoe cover.
24. The shoe cover of any one of embodiments 1-23, wherein the first fastener and/or the second fastener comprises a strap.
25. The shoe cover of any one of embodiments 1-24, wherein the first fastener and/or the second fastener comprises a hook and loop fastener.
26. The shoe cover of embodiment 25, wherein the first cover comprises a loop-compatible hook material or a hook-compatible loop material, and the second cover comprises a loop-compatible hook material or a hook-compatible loop material.
27. The shoe cover of any one of embodiments 1-26, wherein the shoe cover covers at least 50%, at least 55%, at least 60%, at least 65%, at least 70%, at least 75%, at least 80%, at least 85%, at least 90%, at least 91%, at least 92%, at least 93%, at least 94%, at least 95%, at least 96%, at least 97%, at least 98%, at least 99%, or 100% of the outer surface area of the cleated shoe when the cleated shoe is properly inserted into the shoe cover and the first fastener attaches the heel region of the first cover to the heel region of the second cover and the second fastener attaches the toe region of the first cover to the toe region of the second cover.
28. The shoe cover of any one of embodiments 1-27, wherein the first cover and the second cover comprise a material selected from the group consisting of elastic material, elastomeric material, elasticized fabric, and mesh material.
29. A method for covering a cleated shoe using a shoe cover, the method comprising:
inserting a cleated shoe into the shoe cover of any one of embodiments 1-28;
connecting the first cover and the second cover using the first fastener; and
connecting the first cover and the second cover using the second fastener.
30. The method of embodiment 29, wherein the cleated shoe is an athletic shoe selected from the group consisting of soccer shoes, football shoes, track & field shoes, baseball shoes, softball shoes, rugby shoes, cycling shoes, lacrosse shoes, and golf shoes.
31. The method of embodiment 30, wherein the cleated shoe is a boot.
32. The method of any one of embodiments 29-31, wherein the cleated shoe comprises a cleat and the shoe cover comprises a cavity, and wherein each cavity aligns with no more than one cleat of the shoe when the cleated shoe is inserted into the shoe cover.
33. A method for forming a cleat pattern in a shoe cover, the method comprising:
obtaining the shoe cover of embodiment 1;
obtaining a cleated shoe having a cleat pattern formed by one or more cleats;
adding an elastomeric material in an uncured state to the sole;

contacting the one or more cleats of the cleated shoe with the elastomeric material while the elastomeric material is in an uncured state; and curing the elastomeric material.

34. The method of embodiment 33, wherein the elastomeric material is a silicone rubber material.

35. A method for forming a cleat pattern in a shoe cover, the method comprising:

obtaining the shoe cover of embodiment 1;

obtaining a cleated shoe having a cleat pattern formed by one or more cleats;

obtaining a sole insert casing;

adding an elastomeric material in an uncured state to the sole insert casing;

contacting the one or more cleats of the cleated shoe with the elastomeric material while the elastomeric material is in an uncured state; and curing the elastomeric material.

36. The method of embodiment 35, wherein the elastomeric material is a silicone rubber material.

37. A method for forming a cleat pattern in a shoe cover, the method comprising:

obtaining the shoe cover of embodiment 1;

obtaining a cleated shoe having a cleat pattern formed by one or more cleats;

obtaining a sole insert comprising an elastomeric material in an uncured state;

contacting the one or more cleats of the cleated shoe with the elastomeric material while the elastomeric material is in an uncured state; and curing the elastomeric material.

38. The method of embodiment 37, wherein the elastomeric material is a silicone rubber material.

39. A method for manufacturing a shoe cover for use with a cleated shoe, the method comprising:

providing a sole;

connecting a first cover comprising a toe region and a heel region to the sole;

connecting a second cover comprising a toe region and a heel region to the sole;

providing a first fastener that reversibly connects the heel region of the first cover and the heel region of the second cover; and providing a second fastener that reversibly connects the toe region of the first cover and the toe region of the second cover.

40. A kit comprising a pair of shoe covers, the kit comprising a pair of the shoe covers of any one of embodiments 1-28, wherein the pair comprises a shoe cover configured to cover a left shoe and a shoe cover configured to cover a right shoe.

41. A kit comprising a pair of shoe covers, the kit comprising:

a pair of the shoe cover of embodiment 1; and an elastomeric material in an uncured state, wherein the pair comprises a shoe cover configured to cover a left shoe and a shoe cover configured to cover a right shoe.

42. The kit of embodiment 41, wherein the elastomeric material is provided within a container selected from the group consisting of a tube, vile, syringe, bottle, can, and tub.

43. The kit of embodiment 41 or embodiment 42, wherein the elastomeric material is a silicone rubber material.

44. A kit comprising a pair of shoe covers, the kit comprising:

a pair of the shoe cover of embodiment 1; and a sole insert comprising an elastomeric material in an uncured state, wherein the pair comprises a shoe cover configured to cover a left shoe and a shoe cover configured to cover a right shoe.

45. The kit of embodiment 44, wherein the elastomeric material is a silicone rubber material.

46. A kit comprising:

a sole insert casing; and an elastomeric material in an uncured state.

47. A kit comprising a sole insert comprising an elastomeric material in an uncured state.

48. A kit comprising a sole insert comprising an elastomeric material that comprises a cavity.

49. A shoe cover for use with a cleated shoe, comprising:

a sole;

a cover connected to the sole and comprising an opening; and a fastener connected to the cover that reversibly narrows the opening.

50. The shoe cover of embodiment 49, wherein the fastener is a drawstring fastener and comprises a string and a cord lock.

51. The shoe cover of embodiment 50, wherein the string is an elastic string.

52. The shoe cover of any one of embodiments 49-51, wherein the cover comprises an upper region, a left side, and a right side, and the string crosses over the upper region of the cover from the left side to the right side and/or from the right side to the left side.

53. The shoe cover of embodiment 52, wherein the string crosses over the upper region of the cover from the left side to the right side and/or from the right side to the left side at least two times.

54. The shoe cover of embodiment 52, wherein the string crosses over the upper region of the cover from the left side to the right side and/or from the right side to the left side at least three times.

55. The shoe cover of any one of embodiments 49-54, wherein the cover comprises an opening region that surrounds the opening, and wherein the string passes along the opening region.

56. The shoe cover of embodiment 55, wherein the opening region comprises a perimeter around the opening and the string passes along at least 20%, at least 30%, at least 40%, at least 50%, at least 60%, at least 70%, at least 80%, at least 90%, or at least 95% of the perimeter.

57. The shoe cover of any one of embodiments 49-56, wherein the cover comprises a rear side along the opening and the string passes along the rear side.

58. The shoe cover of any one of embodiments 49-57, wherein the shoe cover covers at least 50%, at least 55%, at least 60%, at least 65%, at least 70%, at least 75%, at least 80%, at least 85%, at least 90%, at least 91%, at least 92%, at least 93%, at least 94%, at least 95%, at least 96%, at least 97%, at least 98%, at least 99%, or 100% of the outer surface area of the cleated shoe when the cleated shoe is properly inserted into the shoe cover and the fastener is tightened.

59. The shoe cover of embodiment 57 or embodiment 58, wherein, when the cleated shoe is properly inserted into the shoe cover and the fastener is tightened, the fastener increases tension between the upper region of the cover and the cleated shoe, increases tension between the rear side and the cleated shoe, and narrows the opening.

60. The shoe cover of any one of embodiments 49-59, wherein the sole comprises a lower sole and an upper sole.
61. The shoe cover of embodiment 60, wherein the upper sole comprises a material selected from the group consisting of elastomeric material and foam material.
62. The shoe cover of any one of embodiments 49-61, wherein the shoe cover further comprises a sole insert.
63. The shoe cover of embodiment 62, wherein the sole comprises a lower sole and the sole insert comprises an upper sole.
64. The shoe cover of embodiment 62 or embodiment 63, wherein the sole insert and the shoe cover are reversibly attached.
65. The shoe cover of embodiment 62 or embodiment 63, wherein the sole insert is attached to the shoe cover using an adhesive.
66. The shoe cover of any one of embodiments 62-65, further comprising a sole insert casing that encompasses the sole insert.
67. The shoe cover of embodiment 66, wherein the sole insert casing comprises a heat-resistant elastomeric material.
68. The shoe cover of embodiment 66 or embodiment 67, wherein the sole insert comprises a perimeter and a bottom and the sole insert casing surrounds the perimeter of the sole insert and covers the bottom of the sole insert.
69. The shoe cover of any one of embodiments 66-68, wherein the sole insert casing and the shoe cover are reversibly attached.
70. The shoe cover of any one of embodiments 66-68, wherein the sole insert casing is attached to the shoe cover using an adhesive.
71. The shoe cover of any one of embodiments 62-70, wherein the sole insert comprises a material selected from the group consisting of elastomeric material and foam material.
72. The shoe cover of embodiment 61, wherein the elastomeric material is a silicone rubber material.
73. The shoe cover of embodiment 71, wherein the elastomeric material is a silicone rubber material.
74. The shoe cover of any one of embodiments 60 and 62-70, wherein the upper sole comprises a thermoplastic polymer material.
75. The shoe cover of any one of embodiments 62-70, wherein the sole insert comprises a thermoplastic polymer material.
76. The shoe cover of embodiment 74 or embodiment 75, wherein the thermoplastic polymer material becomes moldable when heated to a sufficiently elevated temperature.
77. The shoe cover of any one of embodiments 61-73, wherein the elastomeric material comprises a cavity that aligns with a cleat protruding from the cleated shoe when the cleated shoe is properly inserted into the shoe cover.
78. The shoe cover of any one of embodiments 74-76, wherein the thermoplastic polymer material comprises a cavity that aligns with a cleat protruding from the cleated shoe when the cleated shoe is properly inserted into the shoe cover.
79. The shoe cover of embodiments 77, wherein the cavity is formed by a process of contacting the cleat of the cleated shoe with the elastomeric material.
80. The shoe cover of embodiments 79, wherein the process of contacting the cleat of the cleated shoe with the elastomeric material is performed while the elastomeric material is in an uncured state.
81. The shoe cover of embodiment 78, wherein the cavity is formed by a process of contacting the cleat of the cleated shoe with the thermoplastic polymer material.
82. The shoe cover of embodiment 81, wherein the process of contacting the cleat of the cleated shoe with the thermoplastic polymer material is performed while the thermoplastic polymer material is in a moldable state after being heated to a sufficiently elevated temperature.
83. The shoe cover of any one of embodiments 77, 79, and 80, wherein each cavity aligns with no more than one cleat of the cleated shoe.
83. The shoe cover of any one of embodiments 78, 81, and 82, wherein each cavity aligns with no more than one cleat of the cleated shoe.
84. The shoe cover of any one of embodiments 49-83, wherein the sole is positioned between a toe end and a heel end of the shoe cover, and wherein the cover extends from the toe end of the shoe cover to the heel end of the shoe cover.
85. The shoe cover of any one of embodiments 49-84, wherein the cover comprises a material selected from the group consisting of elastic material, elastomeric material, elasticized fabric, and mesh material.
86. A method for covering a cleated shoe using a shoe cover, the method comprising:
inserting a cleated shoe into the shoe cover of any one of embodiments 49-85; and
tightening the fastener.
87. The method of embodiment 86, wherein the cleated shoe is an athletic shoe selected from the group consisting of soccer shoes, football shoes, track & field shoes, baseball shoes, softball shoes, rugby shoes, cycling shoes, lacrosse shoes, and golf shoes.
88. The method of embodiment 86, wherein the cleated shoe is a boot.
89. The method of any one of embodiments 86-88, wherein the cleated shoe comprises a cleat and the shoe cover comprises a cavity, and wherein each cavity aligns with no more than one cleat of the shoe when the cleated shoe is inserted into the shoe cover.
90. A method for forming a cleat pattern in a shoe cover, the method comprising:
obtaining the shoe cover of embodiment 49;
obtaining a cleated shoe having a cleat pattern formed by one or more cleats;
adding an elastomeric material in an uncured state to the sole;
contacting the one or more cleats of the cleated shoe with the elastomeric material while the elastomeric material is in an uncured state; and
curing the elastomeric material.
91. The method of embodiment 90, wherein the elastomeric material is a silicone rubber material.
92. A method for forming a cleat pattern in a shoe cover, the method comprising:
obtaining the shoe cover of embodiment 49;
obtaining a cleated shoe having a cleat pattern formed by one or more cleats;
obtaining a sole insert casing;
adding an elastomeric material in an uncured state to the sole insert casing;

contacting the one or more cleats of the cleated shoe with the elastomeric material while the elastomeric material is in an uncured state; and curing the elastomeric material.

93. The method of embodiment 92, wherein the elastomeric material is a silicone rubber material.

94. A method for forming a cleat pattern in a shoe cover, the method comprising:

obtaining the shoe cover of embodiment 49;

obtaining a cleated shoe having a cleat pattern formed by one or more cleats;

obtaining a sole insert comprising an elastomeric material in an uncured state;

contacting the one or more cleats of the cleated shoe with the elastomeric material while the elastomeric material is in an uncured state; and curing the elastomeric material.

95. A method for forming a cleat pattern in a shoe cover, the method comprising:

obtaining the shoe cover of embodiment 49;

obtaining a cleated shoe having a cleat pattern formed by one or more cleats;

obtaining a sole insert comprising a thermoplastic polymer material in a moldable state;

contacting the one or more cleats of the cleated shoe with the thermoplastic polymer material while the thermoplastic polymer material is in the moldable state; and allowing the thermoplastic polymer material to harden.

96. The method of embodiment 95, wherein, the thermoplastic polymer material is in a moldable state following heating the thermoplastic polymer material to a sufficiently elevated temperature.

97. A method for manufacturing a shoe cover for use with a cleated shoe, the method comprising:

providing a sole;

connecting a cover to the sole; and providing a fastener that reversibly narrows an opening in the cover.

98. A kit comprising a pair of shoe covers, the kit comprising a pair of the shoe covers of any one of embodiments 49-85, wherein the pair comprises a shoe cover configured to cover a left shoe and a shoe cover configured to cover a right shoe.

99. A kit comprising a pair of shoe covers, the kit comprising:

a pair of the shoe cover of embodiment 49; and an elastomeric material in an uncured state, wherein the pair comprises a shoe cover configured to cover a left shoe and a shoe cover configured to cover a right shoe.

100. The kit of embodiment 99, wherein the elastomeric material is provided within a container selected from the group consisting of a tube, vile, syringe, bottle, can, and tub.

101. The kit of embodiment 99 or embodiment 100, wherein the elastomeric material is a silicone rubber material.

102. A kit comprising a pair of shoe covers, the kit comprising:

a pair of the shoe cover of embodiment 49; and a sole insert comprising an elastomeric material in an uncured state, wherein the pair comprises a shoe cover configured to cover a left shoe and a shoe cover configured to cover a right shoe.

103. The kit of claim 102, wherein the elastomeric material is a silicone rubber material.

104. A kit comprising a pair of shoe covers, the kit comprising:

a pair of the shoe cover of embodiment 1 or embodiment 49; and a sole insert comprising a thermoplastic polymer material that becomes moldable at a sufficiently elevated temperature, wherein the pair comprises a shoe cover configured to cover a left shoe and a shoe cover configured to cover a right shoe.

105. A kit comprising:

a sole insert casing; and an elastomeric material in an uncured state.

106. A kit comprising a sole insert comprising an elastomeric material in an uncured state.

107. A kit comprising a sole insert comprising an elastomeric material that comprises a cavity.

108. A kit comprising:

a sole insert casing; and a thermoplastic polymer material that becomes moldable at a sufficiently elevated temperature.

109. A kit comprising a sole insert comprising a thermoplastic polymer material that becomes moldable at a sufficiently elevated temperature.

What is claimed is:

1. A shoe cover for use with a cleated shoe, comprising:

a sole;

a sole insert;

a cover connected to the sole and comprising an opening; and a fastener connected to the cover that reversibly narrows the opening, wherein the faster is a drawstring fastener comprising a string and a cord lock, wherein the cover comprises an upper region, a left side, a right side, and a rear side, and the string crosses over the upper region of the cover from the left side to the right side and/or from the right side to the left side at least one time; and wherein the shoe cover further comprises a sole insert casing that encompasses the sole insert, and the sole insert casing surrounds the perimeter of the sole insert and comprises a support member that protrudes inward from the sole insert casing and engages with the sole insert.

2. The shoe cover of claim 1, wherein the cover comprises an opening region that surrounds the opening, wherein the string passes along at least a portion of the opening region such that, when the fastener is tightened, the area of the opening is decreased by at least 50%, at least 55%, at least 60%, at least 65%, at least 70%, at least 75%, at least 80%, at least 85%, at least 90%, or at least 95% compared to the area of the opening when the fastener is partially or fully loosened.

3. The shoe cover of claim 1, wherein the string crosses over the upper region of the cover from the left side to the right side and/or from the right side to the left side at least two times.

4. The shoe cover of claim 1, wherein the string passes along the rear side of the cover.

5. The shoe cover of claim 3, wherein the string passes along the rear side of the cover.

6. The shoe cover of claim 2, wherein the opening region comprises a perimeter around the opening and the string passes along at least 70%, at least 80%, at least 90%, or at least 95% of the perimeter.

7. The shoe cover of claim 1, wherein the sole comprises a lower sole and an upper sole.

8. The shoe cover of claim 7, wherein the upper sole comprises a cavity pattern.

9. The shoe cover of claim 1, wherein the sole comprises a lower sole and the sole insert comprises an upper sole.

10. The shoe cover of claim 1, wherein:

the sole insert is reversibly attached to the shoe cover via a reversible attachment between the sole insert casing and the shoe cover; or the sole insert casing is irreversibly attached to the shoe cover, and the sole insert is reversibly attached to the sole insert casing.

11. The shoe cover of claim 1, wherein the sole insert comprises a thermoplastic polymer material that becomes moldable when heated to a sufficiently elevated temperature.

12. The shoe cover of claim 1, wherein the cover comprises a waterproof material.

13. The shoe cover of claim 1, wherein the cover comprises a material selected from the group consisting of elastic material, elastomeric material, elasticized fabric, and mesh material.

14. The shoe cover of claim 6, wherein the upper sole comprises a cavity of at least ⅙" deep.

15. A kit comprising a pair of shoe covers, the kit comprising:

a pair of the shoe cover of claim 1;

wherein the pair comprises a shoe cover configured to cover a left shoe and a shoe cover configured to cover a right shoe.

* * * * *